US009073114B2

(12) United States Patent
Murakami et al.

(10) Patent No.: US 9,073,114 B2
(45) **Date of Patent: *Jul. 7, 2015**

(54) ENAMELING STEEL SHEET, EXCELLENT IN FISHSCALE RESISTANCE AND METHOD OF PRODUCING THE SAME

(75) Inventors: Hidekuni Murakami, Tokyo (JP); Satoshi Nishimura, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 762 days.

This patent is subject to a terminal disclaimer.

(21) Appl. No.: 12/311,173

(22) PCT Filed: Aug. 13, 2007

(86) PCT No.: PCT/JP2007/066059

§ 371 (c)(1),
(2), (4) Date: Apr. 13, 2009

(87) PCT Pub. No.: WO2008/038474

PCT Pub. Date: Apr. 3, 2008

(65) Prior Publication Data

US 2010/0086431 A1 Apr. 8, 2010

(30) Foreign Application Priority Data

Sep. 27, 2006 (JP) ..... 2006-262694

(51) Int. Cl.
*C22C 38/42* (2006.01)
*B22D 11/00* (2006.01)

(Continued)

(52) U.S. Cl.
CPC ..... *B22D 11/001* (2013.01); *C21D 8/0226* (2013.01); *C21D 8/0236* (2013.01);

(Continued)

(58) Field of Classification Search
CPC ..... C21D 1/76; C22C 38/02; C22C 38/04; C22C 38/06
USPC ..... 420/83; 148/648
See application file for complete search history.

(56) References Cited

U.S. PATENT DOCUMENTS 5,993,974 A 11/1999 Fukushima et al.
2004/0244885 A1 12/2004 Murakami et al.

FOREIGN PATENT DOCUMENTS

CN 1610762 4/2005
JP 36-19385 10/1961

(Continued)

OTHER PUBLICATIONS

NPL: Machine translation of JP2006037215A, Feb. 2006.*

(Continued)

*Primary Examiner* — Jie Yang
(74) *Attorney, Agent, or Firm* — Kenyon & Kenyon LLP

(57) ABSTRACT

The present invention provides a non-aging enameling steel sheet having excellent fishscale resistance characteristics that is suitable for one-coat enameling and a method of producing the same. The enameling steel sheet comprises, in mass %, C: 0.010% or less, Mn: 0.03% to 1.30%, Si: 0.100% or less, Al: 0.010% or less, N: 0.0055% or less, P: 0.035% or less, S: 0.08% or less, O: 0.005% to 0.085%, Nb: 0.055% to 0.250%, and the balance of Fe and unavoidable impurities, in which steel sheet preferably an Fe—Nb—Mn system composite oxide is present, a distribution of Nb mass % concentrations is present in the composite oxide, and the ratio of Nb mass % concentration of a high-concentration portion (Nb max %) to Nb mass % concentration of a low-concentration portion (Nb min %) is Nb max %/Nb min %≥1.2.

22 Claims, 2 Drawing Sheets

(51) Int. Cl.

| | |
|---|---|
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |

(52) U.S. Cl.

CPC ..... *C21D8/0273* (2013.01); *C21D 9/46* (2013.01); *C21D 2211/004* (2013.01); *C22C 38/001* (2013.01); *C22C 38/004* (2013.01); *C22C 38/02* (2013.01); *C22C 38/04* (2013.01); *C22C 38/06* (2013.01); *C22C 38/12* (2013.01)

(56) References Cited

FOREIGN PATENT DOCUMENTS

| | | |
|---|---|---|
| JP | 53-7531 | 1/1978 |
| JP | 53-108023 | 9/1978 |
| JP | 59-74255 | 4/1984 |
| JP | 63-18086 | 1/1988 |
| JP | 63-195284 | 8/1988 |
| JP | 63-293173 | 11/1988 |
| JP | 1-316470 | 12/1989 |
| JP | 03-166336 | 7/1991 |
| JP | 05-331593 | 12/1993 |
| JP | 07-166295 | 6/1995 |
| JP | 2040437 | 3/1996 |
| JP | 10-121141 | 5/1998 |
| JP | 11-6031 | 1/1999 |
| JP | 11-100638 | 4/1999 |
| JP | 2000-1745 | 1/2000 |
| JP | 3111834 | 11/2000 |
| JP | 2001-316760 | 11/2001 |
| JP | 2002-249850 | 9/2002 |
| JP | 2004-084011 | 3/2004 |
| JP | 2006-37215 | 2/2006 |
| WO | WO 03/038140 | 5/2003 |

OTHER PUBLICATIONS

International Search Report dated Nov. 27, 2007 issued in corresponding PCT Application No. PCT/JP2007/066059.

Chinese Office Action dated Jun. 9, 2010 issued in corresponding Chinese Application No. 200780035777X.

International Search Report dated Dec. 11, 2007 issued in corresponding PCT Application No. PCT/JP2007/066218.

Search Report dated Jul. 21, 2014 issued in corresponding European Application No. 2007792675.6.

* cited by examiner

ENAMELING STEEL SHEET, EXCELLENT IN FISHSCALE RESISTANCE AND METHOD OF PRODUCING THE SAME

TECHNICAL FIELD

The present invention relates to an enameling steel sheet excellent in enameling properties (bubble/black spot defect resistance, adhesion, and fishscale resistance) and formability characteristics, and a method of producing the same, particularly to a continuously cast enameling steel sheet outstandingly excellent in fishscale resistance and a method of producing the same.

BACKGROUND ART

Enameling steel sheet has long been used extensively as a material for kitchen equipment such as pots, pans, kettles and sinks, building materials, and the like. Enameling steel sheet has conventionally been produced by ingot casting into capped steel or rimmed steel, blooming, hot rolling and cold rolling, followed by decarburization by open coil annealing and then denitrification annealing to reduce carbon and nitrogen content to several tens of ppm or less. However, the enameling steel sheet produced in this manner has the disadvantage of high production cost because it is produced by ingot casting and blooming and also requires decarburization and denitrification annealing. Another problem is that it cannot be applied to components that require forming by intensive deep drawing.

Recent enameling steel sheet is therefore usually produced by the continuous casting method so as to reduce production cost. In addition, the chemical composition is controlled by inclusion of various addition elements so as to simultaneously achieve good formability and enamelability. To give an example, it is known that Nb and V, for instance, enable production of enameling steel sheet having good formability and enamelability (see, for example, Japanese Patent No. 2040437 and Japanese Patent No. 3435035). This prior art method is low in deoxidation capability and therefore enables the oxygen content of the steel to be kept high and, moreover, is a breakthrough technology in that it adds Nb and V as elements capable of imparting good formability by immobilizing C and N present in the steel as carbide and nitride. Further, the prior art also teaches enameling steel sheet added with Cr and Nb to obtain a product that maintains good formability while resisting softening during firing (see, for example, Japanese Patent Publication (A) No. H11-6031) and enameling steel sheet technology that while unrelated to enamelability and formability, is added with Nb and V for avoiding swelling that under special circumstances may occur situation-specifically during casting when Sn is added (see, for example, Japanese Patent No. 3111834).

Further, the inventors sought to improve Nb- and V-containing enameling steel sheet excellent in fishscale resistance and deep drawability and filed earlier applications (see Japanese Patent Publication (A) No. 2002-249850 and No. 2004-84011). The essence of these technologies lies in controlling oxide form by giving consideration not only to Mn, conventionally the main oxide control element of enameling steel sheet, but also to Al, Nb, V, Si and the like in addition to Mn. Particularly noteworthy is Japanese Patent Publication (A) No. 2002-249850, which includes an unprecedented feature in that it takes the hot rolling conditions into account, with consideration being extended up to change in oxide shape caused by the rolling, so as to incorporate optimum characteristics. The steel sheets according to these techniques achieve stable and high r value and good fishscale resistance, and despite the increase in product cost owing to use of Nb, V and other expensive elements, are being used in increasing amounts chiefly in the high-grade material market.

However, with the recent polarization in use of steel sheet, that is, the use of low cost materials as much as possible for general purpose products and, on the other hand, materials with characteristics superior to those in the past for high grade products, these materials are being required to offer still better formability and enamelability. In particular, a very strong need is felt for further improvement of fishscale resistance, which can be said to be the most salient feature of enameling steel. It is known that in enameling steel sheet, fishscale can be effectively inhibited by forming voids in the steel sheet and trapping in the voids hydrogen entering the steel sheet during firing of the enamel. However, mere formation of voids does not improve the hydrogen trapping ability but, as can be seen from Japanese Patent Publication (A) No. H11-6031 and Japanese Patent No. 3111834, for example, the effect of controlling the form of the oxides is not clear. Viewed in this regard, it cannot be said that even Japanese Patent Publication (A) No. H11-6031 and Japanese Patent No. 3111834 achieve optimum control in the aspects of void volume, form and property, so that there can be considered to be a possibility for further improvement of fishscale resistance by controlling the steel composition and the oxides present in the steel.

DISCLOSURE OF THE INVENTION

The object of the present invention is therefore to further develop the aforesaid enameling steel sheet technologies so as to provide a non-aging continuously cast enameling steel sheet that is excellent in enamel fishscale resistance and suitable for one-coat enameling, and a method of producing the same.

The present invention was achieved through various and extensive studies for optimizing the conventional steel sheet and steel sheet production method to the utmost. Studies regarding the enameling characteristics of enameling steel sheet were focused particularly on Nb-containing steel with attention to the effect of the production conditions, especially the steelmaking conditions. As discussed later, one point of the invention technology is that it utilizes the thermodynamic oxide compositional variation (heterogeneity) during steelmaking through solidification. It is basically a technology utilizing the non-equilibrium state of the system. During the process, more pronounced segregation can be formed in proportion as the amount of segregated elements present in the system is larger. Of particular note is that a major technological characteristic of the present invention can be said to be that segregation of Nb and Mn in the oxides is amplified to a high degree by increasing the amount of added Nb and Mn.

With regard to enameling properties, fishscale property, bubble/black spot surface defects, and adhesion were investigated in powder coating (dry) by conducting two-coat enameling by application of an underglaze and an overglaze each to a coating thickness of 100 μm. As a result, the following findings (A)-(E) were newly made in addition to the finding regarding increase of the amount of added Nb and Mn:

(A) While fishscale resistance can be enhanced by regulating the steel composition, enhancement to a still higher degree is possible by further making oxides present in the steel and tends to improve in proportion as the segregation of elements in the oxides is greater.

(B) For one and the same amount of added Nb, formability, particularly r value, tends to improve in the case of larger segregation of Nb in the oxides.

(C) At this time, the yield from addition of the expensive addition element B is also improved.

(D) The variation in element concentration in the oxides must be considered also taking into account oxides elongated, fractured and dispersed by rolling.

(E) The degree of variation in the concentration of elements in the oxides can be controlled by controlling the timing of addition of the elements, particularly the oxide-forming elements, during steelmaking.

(F) Oxides having variation in element concentration can be desirably deformed to effectively produce voids in the final product by suitably controlling the hot-rolling conditions, particularly the rolling temperature and strain rate.

The present invention was completed based on the above findings and the gist thereof is as follows:

(1) An enameling steel sheet excellent in fishscale resistance characterized by comprising, in mass %, C: 0.0003% to 0.010%,
Si: 0.001% to 0.100%,
Mn: 0.03% to 1.30%,
Al: 0.0002% to 0.010%,
N: 0.0055% or less,
P: 0.035% or less,
S: 0.08% or less,
O: 0.005% to 0.085%,
Nb: greater than 0.055% to not greater than 0.250%, and
the balance of Fe and unavoidable impurities.

(2) The enameling steel sheet excellent in fishscale resistance as set forth in (1), characterized by further comprising, in mass %, one or two or more of B: 0.0003 to 0.0030%,
V: 0.003 to 0.15%,
Ni: 0.0001 to 0.05%,
Ti: 0.0001 to 0.05%,
Cu: 0.0001 to 0.05%,
Cr: 0.0001 to 0.05%,
one or more of Ta, W, Mo, La, Ce, Ca and Mg in a total of 1.0% or less, and
one or more of As, Se, Sn and Sb in a total of 1.0% or less.

(3) The enameling steel sheet excellent in fishscale resistance as set forth in (1) or (2), characterized in that an Fe—Nb—Mn system composite oxide is present in the steel sheet, a distribution of Nb mass % concentrations is present in the composite oxide, and the ratio of Nb mass % concentration of a high-concentration portion (Nb max %) to Nb mass % concentration of a low-concentration portion (Nb min %) is Nb max %/Nb min %≥1.2.

(4) The enameling steel sheet excellent in fishscale resistance as set out in (3), characterized in that another Fe—Nb—Mn system composite oxide having an Nb mass % concentration of not less than 1.2 times or not greater than 1/1.2 times the Nb mass % concentration of said composite oxide is present in the steel sheet, straight line distance between the centers of the two composite oxides is not less than 0.10 μm and within 20 μm, and a straight line connecting the centers of the two oxides lies at an angle within ±10° of a rolling direction.

(5) The enameling steel sheet excellent in fishscale resistance as set forth in (3) or (4), characterized in that an Fe—Nb—Mn system composite oxide is present in the steel sheet, variation of Mn mass % concentration is present in the composite oxide, and the ratio of Mn mass % concentration of a high-concentration portion (Mn max %) to Mn mass % concentration of a low-concentration portion (Mn min %) is Mn max %/Mn min %≥1.2.

(6) The enameling steel sheet excellent in fishscale resistance as set forth in (5), characterized in that another Fe—Nb—Mn system composite oxide having an Mn mass % concentration of not less than 1.2 times or not greater than 1/1.2 times the Mn mass % concentration of said composite oxide is present in the steel sheet, straight line distance between the centers of the two composite oxides is not less than 0.10 μm and within 20 μm, and a straight line connecting the centers of the two oxides lies at an angle within ±10° of a rolling direction.

(7) A method of producing a continuously cast enameling steel slab excellent in fishscale resistance, characterized in that, in a process of making and continuously casting a steel of the composition set forth in (1) or (2), addition of the Mn and Nb to molten steel during steelmaking is performed by a procedure of adding 80% or greater of the total amount of Mn to be added, allowing 1 minute or more to pass, adding 80% or greater of the total amount of Nb to be added, and conducting continuous casting within a period of 60 minutes.

(8) The method of producing a continuously cast enameling steel slab excellent in fishscale resistance as set forth in (7), characterized in that in the continuous casting, the cooling rate during solidification at a slab-thickness direction layer measuring ¼ the slab thickness is not greater than 10° C./sec.

(9) The method of producing a continuously cast enameling steel slab excellent in fishscale resistance as set forth in (7) or (8), characterized in that Fe—Nb—Mn system composite oxide of an average diameter of 1.0 μm or greater is formed in the continuously cast steel slab, a distribution of Nb mass % concentrations is present in the composite oxide, and the ratio of Nb mass % concentration of a high concentration portion (Nb max %) to Nb mass % concentration of a low concentration portion (Nb min %) is Nb max %/Nb min %≥1.2.

(10) The method of producing a continuously cast enameling steel slab excellent in fishscale resistance as set forth in any one of (7) to (9), characterized in that Fe—Nb—Mn system composite oxide of an average diameter of 1.0 μm or greater is formed in the continuously cast steel slab, variation of Mn mass % concentration is present in the composite oxide, and the ratio of Mn mass % concentration of a high concentration portion (Mn max %) to Mn mass % concentration of a low concentration portion (Mn min %) is Mn max %/Mn min % 1.2.

(11) The method of producing a continuously cast enameling steel slab excellent in fishscale resistance as set forth in any one of (7) to (10), characterized in that when, following the continuous casting process, a continuously cast steel slab of thickness of 50 mm or greater is hot rolled at 600° C. or greater, rolling is first conducted under conditions of 1000° C. or greater and strain rate of 1/sec or greater to a total true strain of 0.4 or greater and rolling is then conducted under conditions of 1000° C. or less and strain rate of 10/sec or greater to a total true strain of 0.7 or greater.

(12) A method of producing a continuously cast enameling steel sheet excellent in fishscale resistance, characterized in that when, following making and continuously casting a steel of the composition set forth in (1) or (2), a continuously cast steel slab of a thickness of 50 mm or greater is hot rolled at 600° C. or greater, rolling is first conducted under conditions of 1000° C. or greater and strain rate of 1/sec or greater to a total true strain of 0.4 or greater and rolling is then conducted under conditions of 1000° C. or less and strain rate of 10/sec or greater to a total true strain of 0.7 or greater.

BEST MODE FOR WORKING THE INVENTION

Figure 1:
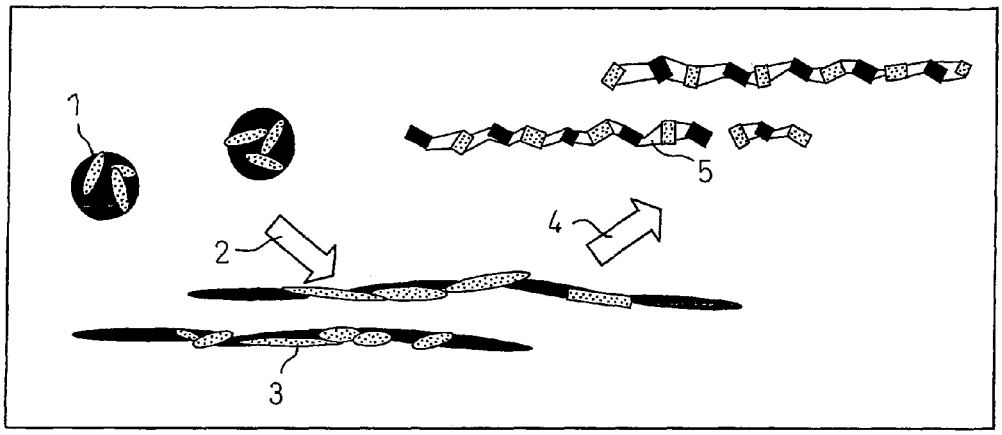
FIG. 1 is a schematic diagram illustrating a state in which coarse composite oxides are elongated and fractured to form fracture voids (hydrogen trapping capability) in the steel sheet.

The present invention will now be explained in detail.

First, explanation will be made with regard to the composition and content ranges of the steel (% means mass % in the following).

C: 0.0003 to 0.010%

It is conventional knowledge that formability improves with lower C content. In the present invention, C content is made 0.010% or less. To obtain high elongation and r value, it is preferably made 0.0025% or less. The more preferable range is 0.0015% or less. While there is no particular need to specify a lower limit, one of 0.0003% is preferable because C content reduction increases steelmaking cost.

Si: 0.001 to 0.100%

Si can be included in a small amount to control the composition of oxides. To obtain this effect, the content is made 0.001% or greater. On the other hand, excessive content not only tends to impair the enameling characteristics but also forms a large amount of Si oxides poor in ductility in hot rolling and may in some case lower the fishscale resistance, so the content is made 0.100% or less. The content is preferably 0.03% or less and more preferably 0.015% or less. From the viewpoint of improving the bubble resistance and black spot defect resistance etc. and obtain still better enamel surface properties, the preferable range is 0.008% or less.

Mn: 0.03 to 1.30%

Mn is an important constituent that affects variation in oxide composition by working in association with the added amounts of oxygen and Nb. Simultaneously, it is an element that prevents hot embrittlement due to S at the time of hot rolling. In the present invention, which calls for inclusion of oxygen, the content is made 0.03% or greater. It is desirably 0.05% or greater. In general, a high amount of Mn degrades enamel adhesion and makes occurrence of bubbles and black spot defects more likely. In the steel of the present invention, which actively uses Mn to the maximum extent as an oxide, Mn addition causes little degradation of these properties. Rather, addition of Mn facilitates oxide composition control, so Mn is positively added. That is, the upper limit of Mn content is defined as 1.30%. The upper limit is preferably 0.80%, and the upper limit of Mn is still more preferably 0.60%.

Al: 0.0002 to 0.010%

Al is an oxide-forming element. To improve the fishscale resistance as one of the enameling characteristics, it is preferable to include a suitable amount of oxygen in the steel as oxides in the steel material. To obtain this effect, 0.0002% or greater of Al is included. On the other hand, Al is a strong deoxidizing element that if added in a large amount not only would make it difficult to retain the amount of oxygen required in the steel by the present invention but also might degrade fishscale resistance by forming a large amount of Al oxides poor in ductility during hot rolling. Therefore, the Al content is made 0.010% or less. The content is preferably 0.005% or less.

N: 0.0055% or less

N, like C, is an interstitial solute element. If included in a large amount, then even if Nb, and further V, B or other nitride-forming elements are added, formability tends to deteriorate and production of a non-aging steel sheet becomes difficult. For this reason, the upper limit of N is made 0.0055%. Preferably the content is made 0.0045% or less. A lower limit does not particularly have to be set, but with current steelmaking technology, production with less than 0.0010% would be costly, so the content is preferably made 0.0010% or greater.

P: 0.035% or less

P is an element contained as an unavoidable impurity. If the content of P becomes high, it affects the reaction between the glass and steel at the time of firing the enamel. In particular, P segregating in a high concentration at the grain boundaries of the steel sheet may degrade the enamel appearance with bubbles, black spot defects and the like. In the present invention, P content is made 0.035% or less, preferably 0.025% or less, more preferably 0.015% or less, and still more preferably 0.010% or less.

S: 0.08% or less

S forms Mn sulfides. In particular, coprecipitation of these sulfides with oxides has the effect of making the formation of voids at the time of rolling more efficient, thus improving the fishscale resistance. This element need not be contained at all, i.e., a content of 0% is acceptable, but to obtain the above effect, 0.002% or greater is necessary. The content is preferably 0.005% or greater, more preferably 0.010% or greater, and still more preferably 0.015% or greater. However, if the content is too high, the effect of the Mn required for controlling the composition of the oxides playing an essential role in the present invention may decline, so the upper limit is made 0.08%. The content is preferably 0.060% or less and still more preferably 0.040% or less.

O: 0.005 to 0.085%

O is an element required for formation of composite oxides. It is an essential element in the present invention because it directly affects fishscale property and formability, and also affects fishscale resistance by working in association with the Mn and Nb contents. For these effects to be exhibited, a content of 0.005% or greater is necessary. Preferably, the content is 0.010% or greater, more preferably 0.015% or more, more preferably 0.015% or greater, and still more preferably 0.020% or greater. On the other hand, if the amount of oxygen becomes high, the high oxygen content directly degrades formability. It also increases the amount of Nb addition required by the present invention, thus indirectly increasing the cost of addition. The upper limit is therefore preferably made 0.085%, more preferably 0.065% or less, and still more preferably 0.055% or less.

Nb: greater than 0.055% to not greater than 0.250%

Nb is an essential element in the present invention. Nb improves deep drawability by immobilizing C and N. Although it is also required for imparting non-aging property and high formability, in the present invention it is included for imparting a special effect totally different from these. Specifically, the added Nb operates to effectively prevent fishscale by combining with oxygen in the steel to form oxides. A content of greater than 0.055% is necessary to obtain this effect. The content is preferably 0.061% or greater, more preferably 0.071% or greater, still more preferably 0.076% or greater, and most preferably 0.081% or greater. However, at high amount of addition, deoxidation occurs at the time of Nb addition, which not only makes it difficult to retain oxides in the steel but also degrades bubble and black spot defect resistance. The upper limit is therefore made 0.250%. The content is preferably 0.150% or less and more preferably 0.120% or less.

One or both of B: 0.0003 to 0.0030% and V: 0.003 to 0.15%

B and V are elements having effects similar to Nb. When the effects of the elements are viewed individually, the upper limit of B addition is found to be low as regards castability during continuous casting and its formability enhancing effect is lower than that of Nb. The effect of V on formability is similar to that of Nb, and although its upper limit region is broad in terms of balance with the amount of oxygen remaining in the steel, its effect of improving fishscale resistance in the case where variation in composition as oxide is present is smaller than that of Nb and its alloying cost is higher than that of Nb. In the present invention, B and V are added individually or in combination as required. However, in the present invention, which requires Nb, combined addition of B and V broadens the range of variation in oxide composition and, as such, produces an outstanding effect with regard to fishscale resistance enhancement.

For this effect to be obtained with B, a content of 0.0003% or greater is required. B also works to improve adhesion and can also be added for this purpose. The content of B is preferably 0.0006% or greater, more preferably 0.001.0% or greater, and still more preferably 0.0015% or greater. From the viewpoint of castability, the upper limit is 0.0030% or less. Depending on the amount of Nb, addition of excessive B may, when the Nb content is relatively high, markedly increase the recrystallization temperature, thus making very high-temperature annealing necessary for achieving good formability after cold rolling/annealing and thus degrading annealing productivity. The upper limit of B content is therefore made 0.0030% or less. Particularly in the case where Nb content is 0.061% or greater, B content is preferably 0.00250% or less.

For the foregoing effect to be obtained with V, a content of 0.003% or greater is required. The content is preferably 0.006% or greater, more preferably 0.010% or greater, and still more preferably 0.015% or greater. From the viewpoint of cost of addition and bubble/black spot defect resistance, the upper limit is made 0.15%. When the Nb content is 0.080% or greater and the invention effect is obtained by Nb alone, V content is preferably made 0.060% or less and more preferably 0.040% or less.

One or both of Ni: 0.0001 to 0.05% and Ti: 0.0001 to 0.05%,

Ni and Ti are included in the oxides in combination and have an effect on oxide control. When the amount thereof is relatively small, they segregate in the oxides to produce a favorable effect of locally varying ductility and hardness.

For the foregoing effect to be obtained with Ni, a content of 0.0001% or greater is required. The content is preferably 0.0011% or greater, more preferably 0.0031% or greater, and still more preferably 0.0056% or greater. For the foregoing effect to be obtained with Ti, a content of 0.0001% or greater is required. The content is preferably 0.0006% or greater, more preferably 0.0011% or greater, still more preferably 0.0016% or greater, and most preferably 0.0021% or greater. On the other hand, excessive content promotes homogenization of the oxide physical properties, and as this may influence the characteristic effect of the present invention, upper limits are preferably defined. Ni and Ti contents are preferably both made 0.05% or less. Their contents are preferably 0.0390% or less, more preferably 0.0290% or less, still more preferably 0.0241% or less, and most preferably 0.0190%.

One or more of Ta, W, Mo, La, Ce, Ca and Mg in a total of 1.0% or less.

Ta, W, Mo, La, Ce, Ca and Mg are unavoidably entrained from the ore, scrap and other raw materials. Although they are not elements requiring positive addition, they work similarly to Nb to effectively prevent fishscale, so that one or more of these elements can be included in a total of 1.0% or less. The content thereof is preferably 0.5% or less and more preferably 0.1% or less. If included in a large amount, their reaction with the oxide-forming elements is no longer negligible, so that the composition and form of the composite oxides becomes undesirable.

Cu: 0.0001 to 0.05%

Cu is included for controlling the reaction of the glass and steel during enamel firing. In one-coat enameling, the Cu segregated at the surface at the time of pretreatment has the effect of promoting micro-variations in the reaction, thereby improving adhesion. In two-coat enameling, the action attributable to segregation at the surface is slight but Cu affects microreactions between the underglaze and steel. To obtain these effects, Cu is added as required to a content of 0.0001% or greater. Unintentional excess addition not only inhibits the reaction between the glass and steel but may also degrade formability, so to avoid these detrimental effects the content is preferably made 0.05% or less. The content is preferably 0.029% or less and more preferably 0.019%.

Cr: 0.0001 to 0.05%

Cr improves formability and also contributes to fishscale resistance enhancement. Cr combines with oxygen to be incorporated in oxides in the manner of a composite, thereby affecting the oxide control. When the amount thereof is relatively small, the Cr segregates in the oxides to produce a favorable effect of locally varying ductility and hardness. However, excessive content promotes homogenization of the oxide physical properties, and as this may influence the characteristic effect of the present invention, an upper limit is preferably defined. A Cr content of 0.0001% or greater is required to obtain the foregoing effects. The Cr content is preferably made 0.0011% or greater, more preferably 0.0031% or greater, and still more preferably 0.0056% or greater. The upper limit is preferably set at 0.05% or less, more preferably 0.0390% or less, still more preferably 0.0290% or less, still more preferably 0.0241% or less, and most preferably 0.0190%.

One or more of As, Se, Sn and Sb in a total of 1.0% or less

As, Se, Sn and Sb are unavoidably entrained from the ore, scrap and other raw materials. One or more thereof can be included at a total content of 1.0% or less without particularly inhibiting the effect of the present invention. Notwithstanding, positive addition in a greater amount is acceptable when the addition can be expected to produce merits with regard to production and/or quality that are in addition to and beyond the merits envisioned by the present invention.

Since other unavoidable impurities may have an adverse effect on material properties and enameling properties, they should be minimized.

The good fishscale resistance effect of the invention can be achieved without conducting oxide control. Of particular note, however, is that when oxide control is conducted to control variation in composite oxide composition so as to enhance void formation performance within the steel sheet and thus amplify hydrogen trapping capability, it becomes possible to achieve an enameling steel sheet that possesses outstandingly good fishscale resistance, does not experience bubble/black spot defects and the like, and is also excellent in enamel adhesion, not only in direct one-coat enameling but also in two-coat enameling.

Moreover, in the present invention, the final product having passed through a rolling process that includes one or both of hot rolling and cold rolling, is characterized in that the oxides therein, irrespective of whether oxides differing in composition or composite oxides formed by consolidation of such oxides, are imparted internally with large variations in composition and are further made to be present in specific, desirable forms.

First, the Fe—Nb—Mn system composite oxides obtained by consolidating the Fe, Mn, Si, Al, Nb and other oxides that are the subject of the present invention are given a diameter of 0.10 μm or greater. The effect of oxides below this size range on fishscale resistance, a primary feature of the invention steel characteristics, i.e., on improving hydrogen permeation inhibiting capability, is very small. The characteristics of the oxides explained below are recognized even if the diameter of the subject oxides is 0.50 μm or greater, preferably 1.0 μm or greater and more preferably 2.0 μm or greater. Considered in terms of the effect of the present invention, there is no need to set an upper limit on the diameter. However, although the situation differs depending on oxygen content, an increase in coarse oxides decreases the oxide number density to reduce the hydrogen permeation inhibiting effect. Further, it is known generally that excessively coarse oxides impair formability by acting as steel sheet crack starting points when the product sheet is worked. Taking these points into account, it is preferable to restrict the average diameter of the oxides to 15 μm or less, preferably 10 μm or less and more preferably 5 μm or less.

One feature characterizing the Fe—Nb—Mn system composite oxides defined by the present invention is the Nb concentration of the oxides. The present invention requires that oxides be defined as ones having high concentration and ones having low concentration. Among oxides observed within a 100 μm×100 μm field of observation, 100 oxides of 0.1 μm diameter or greater are measured for Nb concentration. To be more specific, the present invention is characterized in that when the concentrations of composite oxides observed within a 100 μm×100 μm field of observation in a sheet cross section are measured, there are found to be present oxides differing in Nb concentration such that the ratio of high-concentration Nb concentration (Nb max) to low-concentration Nb concentration (Nb min) is Nb max/Nb min≥1.2. As discussed later, when the Nb concentration ratio becomes 1.2 or greater, form variation of the oxides during rolling and attendant formation of voids proceeds efficiently, whereby the fishscale resistance is markedly enhanced. The ratio is preferably 1.5 or greater, more preferably 2.0 or greater, still more preferably 4.0 or greater, and most preferably 6.0 or greater. Although no particular upper limit is defined, the preferable upper limit in view of operational considerations is up to 10.0.

Another feature is that a similar difference in composition is also present regarding Mn content. Specifically, the present invention is characterized in that within a 100 μm×100 μm field of observation in a sheet cross section, there are present in the steel sheet unconsolidated composite oxides differing in Mn concentration such that the ratio of high-concentration Mn concentration (Mn max) to low-concentration Mn concentration (Mn min) is Mn max/Mn min≥1.2. When the Mn concentration ratio becomes 1.2 or greater, then, as in the case of Nb, form variation of the oxides during rolling and attendant formation of voids proceeds efficiently, whereby the fishscale resistance is markedly enhanced. The ratio is preferably 1.5 or greater, more preferably 2.0 or greater, still more preferably 4.0 or greater, and most preferably 6.0 or greater. Although no particular upper limit is defined, the preferable upper limit in view of operational considerations is up to 10.0.

Although the method of measuring the concentrations of the individual elements in the oxides that is used for defining the present invention is not particularly limited, the concentrations of the individual oxides need to be specified. Further, as discussed later, it is necessary to define the concentration variation in a single oxide, so that it is convenient to use, for example, an energy-dispersive X-ray analyzer (EDXA)

While an ordinary measurement method suffices, the need to determine concentration at microscopic regions makes it necessary to be particularly careful about adequately reducing the electron beam diameter and other such matters. Further, it is only necessary know the relative value of the Nb concentration and determination of the absolute value is not required. When an EDXA is employed, the ratio of the detection peaks can be used. Caution is necessary regarding the fact that the ratio between the high-concentration portions and low-concentration portions tends to increase as the size of the measured region becomes smaller. The extreme would be where the concentration is measured for regions the size of single atoms, in which case it is conceivable that a high-concentration portion would have a concentration of 100% and a low-concentration portion a concentration of 0%. In this invention, average values for regions of around 0.01 to 0.1 μm are used, with consideration to the electron beam radiation area of the TEM and SEM the inventors ordinarily use. Precisely speaking, information is obtained for a region broader than the set diameter of the electron beam because the electron beam spreads within the irradiated object. In this invention, it is possible to use a value obtained by setting the electron beam diameter equal to the diameter of the region in mind or to scan a somewhat small region with the electron beam and use the average value thereof.

It is not clear why fishscale resistance in particular, namely the hydrogen permeation inhibiting capability, improves in this way when concentration differences are present in the oxide concentration, but the reason is thought to be as follows. As discussed later, the scattered composite oxides in the invention steel are thought to come from composite oxides that were originally unitary. In other words, oxides that were large and unitary when the steel was cast following composition control are thought to become elongated, fractured and finely dispersed. The elongation and fracturing occur primarily in the rolling process, with the oxide being elongated chiefly during hot rolling and fractured chiefly during cold rolling. If differences in composition should be present in the oxide during this process, the degree of elongation differs at different regions, making the shape of the oxides complicated, from which it can be anticipated that fracture occurs preferentially at narrow (thin) regions and, moreover, that regions where shape variation is large fracture preferentially owing to the concentration of flow stress. As a result, regions differing in composition efficiently fracture and disperse. It is thought that during this efficient fracturing, many voids are formed that become the hydrogen trapping sites in the steel needed to markedly improve the hydrogen permeation inhibiting capability, i.e., the fishscale resistance, required by the enameling steel sheet. The foregoing will be concretely explained with reference to the drawings.

Figure 2:
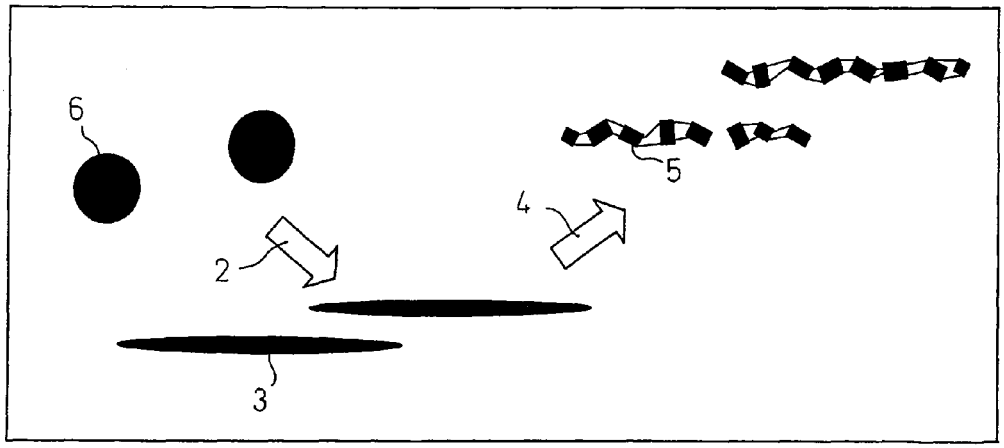
FIG. 2 is a schematic diagram illustrating a state in which coarse oxides are elongated and fractured to form fracture voids (hydrogen trapping capability) in the steel sheet.
Figure 3:
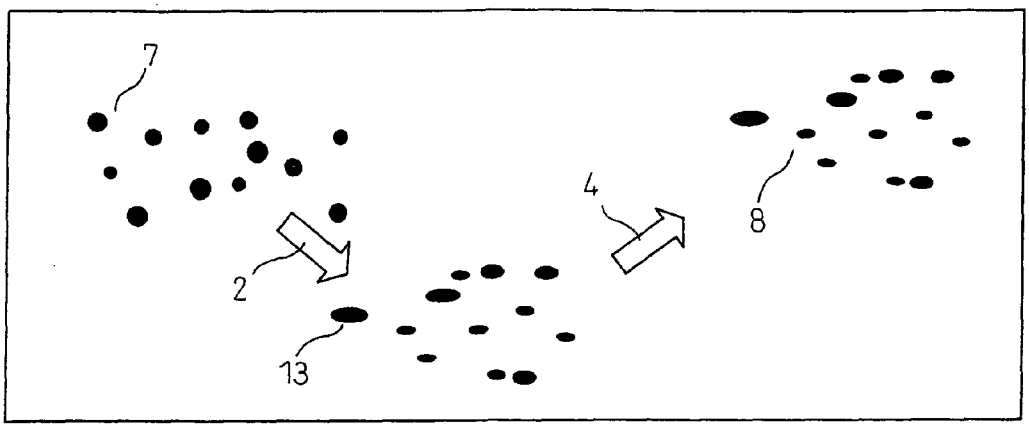
FIG. 3 is a schematic diagram showing that fracture voids are not formed when fine oxides are present.

As shown in FIG. 1, when large Nb and Mn concentration differences are present in the oxides, the coarse complex oxides 1 experience elongation 3 by hot rolling 2 and are fractured by cold rolling 4, thereby improving the fishscale resistance of the steel sheet by efficiently forming fracture voids 5 therein. On the other hand, as shown in FIG. 2, with mere incorporation of coarse oxides in the conventional manner, the coarse oxides 6 experience elongation 3 under the hot rolling 2 but are not readily fractured by the cold rolling 4, making it impossible to obtain desired fracture voids 5 like those in the invention steel. As shown in FIG. 3, at the slab stage, fine complex oxides 7 do not undergo the elongation 3 under the hot rolling 2 and do not experience much fracture under the cold rolling 4, so that voids 8 are not readily produced.

Figure 4:
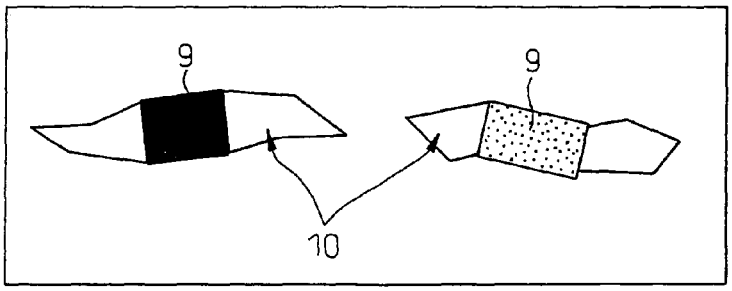
FIG. 4 is a diagram showing that voids become larger with oxides differing in concentration.
Figure 5:
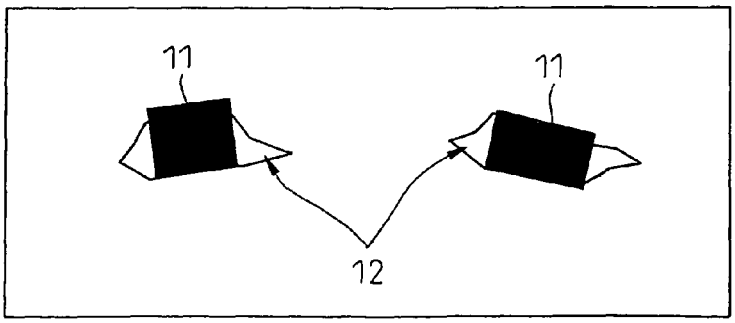
FIG. 5 is a diagram showing that voids are few with oxides of the same concentration.

Although FIGS. 1 and 2 show the case where the distance between the fractured complex oxides is relatively short and voids remain between the complex oxides, the effect of the present invention can also be fully obtained even when the voids between the complex oxides formed by the elongation and fracturing caused by the hot rolling and cold rolling disappear because they are crushed by rolling in the same hot rolling and cold rolling processes. This situation is shown schematically in FIGS. 4 and 5. As shown in FIG. 4, in the case of the invention steel having large differences in concentration of Nb and Mn in the composite oxides and incorporating composite oxides with large void formation capability (oxides 9 of differing concentration), the voids around the complex oxides become larger (10 where the void space is large) and more desirable for improvement of fishscale resistance. Another characterizing feature is that complex, oxides with different compositions have a distinctive relative positional relationship in the steel sheet. Specifically, a composite oxide exhibiting high Nb concentration and a composite oxide exhibiting low Nb concentration are characterized in having a concentration ratio of 1.2 or greater and being located such that a straight line connecting the centers of the two oxides lies at an angle within ±10° of the rolling direction and straight line distance between the centers of the composite oxides is not less than 0.10 μm and within 20 μm. The aforesaid angle is preferably within ±7° of the rolling direction, more preferably within ±5°, and still more preferably within ±3°, so that the oxides are characterized in being linearly aligned in the rolling direction. In contrast, as shown in FIG. 5, in the case of oxides 11 of the same concentration, the voids around the oxides are smaller than in the case of oxides of different concentration (12 where the void space is small), so that the improvement in fishscale resistance is small.

While the reason for this is not clear, it is important for the hydrogen diffusion inhibiting capability required by the steel sheet to be able to prevent permeation of hydrogen from the thickness-direction center of the steel sheet toward the surface thereof, from which it follows that it would be disadvantageous to achieving the purpose of the present invention if, for example, the composite oxides should be aligned in the sheet thickness direction so as to permit formation of a flow of hydrogen along the composite oxides in the sheet thickness direction. It is therefore reasonable to assume that the composite oxides that characterize the present invention enable further improvement of properties owing to their alignment in parallel with the steel sheet surface. It goes without saying that is no need to limit the alignment to a specific angle relative to the rolling direction as in the foregoing if alignment parallel to the steel sheet surface can be achieved. However, in ordinary methods of production, it is difficult, for example, to make the complex oxides align in the sheet-width direction, while the rolling can be assumed to disperse the composite oxides, so the present invention defines the alignment by the angle from the rolling direction.

Moreover, the subject complex oxides are characterized in being located so that straight line distance therebetween is not less than 0.10 μm and within 20 μm. Outside this range, the fishscale resistance diminishes. The distance is preferably 0.20 μm or greater, more preferably 0.30 μm or greater, still more preferably 0.40 μm or greater, and most preferably 0.50 μm or greater. The reason why the lower limit of the distance influences the effect of the invention is not clear, but it is believed that the subject complex oxides may have fine complex oxides or complex oxides with small concentration differences present between them and that the ability to inhibit hydrogen permeation is affected by these complex oxides. In other words, when the subject complex oxides are too close, the overall length of the strings of complex oxides having hydrogen trapping capability become shorter, so many interstices for stopping the flow of hydrogen toward the surface are formed and the ability to inhibit hydrogen diffusion falls. Further, the upper limit is preferably 20 μm or less, more preferably 10 μm or less, still more preferably 5 μm or less, and most preferably 1 μm or less. The reason for defining the upper limit is that a state in which the subject complex oxides are too far apart is inconsistent with the thinking of the present invention, which is based on the assumption of originally unitary coarse composite oxides being elongated and fractured. In the ordinary method of production, the oxides are usually located within 0.5 μm of each other Further, the effect of the present invention is exhibited even without the complex oxides differing in composition being completely separated. More specifically, it suffices if an individual complex oxide present in the steel sheet has internal variation in Nb concentration and the ratio of the Nb concentration of the high concentration portion (Nb max) to the Nb concentration of the low concentration portion (Nb min) is Nb max/Nb min %≥1.2. The ratio is preferably 1.5 or greater, more preferably 2.0 or greater, still more preferably 2.5 or greater, and most preferably 3.0 or greater. Similarly, it suffices if an individual composite oxide present in the steel sheet has internal variation in Mn concentration and the ratio of the Mn concentration of the high concentration portion (Mn max) to the Mn concentration of the low concentration portion (Mn min) is Mn max/Mb min %≥1.2. The ratio is preferably 1.5 or greater, more preferably 2.0 or greater, still more preferably 4.0 or greater, and most preferably 6.0 or greater.

The reason is believed to be that if the process of elongating and fracturing the coarse complex oxides, which as explained above were originally unitary, does not completely fragment them, they may appear to be in an at least partially connected state, at least under ordinary observation. In this case as well, the complex oxides become extremely complicated in shape, and voids are effectively formed around them to act as hydrogen trapping sites, and defects that form along the changes in the deformability mainly owing to variation in concentration of chiefly the complex oxides trap hydrogen to make the effect of the present invention noticeable.

The present invention envisions making particularly desirable complex oxides present as Fe—Nb—Mn system composite oxides. Optimum control of the composition and form (arrangement) of these complex oxides is a feature of the present invention. Specifically, differences in composition of the complex oxides mean differences in the characteristics of the complex oxides, for example, their hardness and/or ductility, and by exerting a large effect on the state of composite oxide elongation and fracture of the composite oxides by hot rolling and cold rolling, they enable control to the desirable form. It is preferable for the Fe—Nb—Mn system composite oxides to be given a total content of Nb, Mn and Fe of 80% or greater.

When the steel composition and production conditions, particularly the production conditions and hot rolling heating conditions, cause the composite oxides to incorporate numerous elements such as Si, Al, V, B and the like, the situation becomes increasingly complicated, so that control of the content of the individual elements in the composite oxides becomes highly important from the viewpoint of enhancing the steel sheet properties. In addition, if the S content increases, MnS coprecipitates in the composite oxides and, as a result, the effect of the present invention is amplified owing to the great difference between sulfides and oxides in their elongation property and fracture property. In particular, the effect that the interaction between MnS and oxides has on fishscale resistance appears more strongly in steel containing Nb than in a conventional steel, so this effect can be consider a feature of the MnS whose precipitation is promoted using complex oxides containing Mn and Nb as a nuclei.

Next, explanation will be made regarding the method of producing the enameling steel sheet excellent in fishscale resistance of the present invention.

The present invention permits production by ordinary steelmaking, continuous casting and steel sheet fabrication processes. However, particularly in the case of imparting the composite oxide with the compositional variation that is a distinctive feature for achieving the effect the present invention to the utmost, it is advantageous from the viewpoint of productivity to conduct the addition of Mn and Nb to the molten steel during the steelmaking and casting processes by the procedure of adding 80% or greater of the total amount of Mn to be added, allowing 1 minute or more to pass, adding 80% or greater of the total amount of Nb to be added, and conducting casting within a period of 60 minutes. In the case of also adding V and B, which have effects similar to Nb, basically it is preferable to make the addition starting from the one that is the weakest deoxidizer, and the effect of the present invention can be more markedly realized by conducting addition in the order of Mn, V, Nb and B.

In the addition, 80% or greater of the total addition amount of each element is added and then the next element is added. This is because the effect of deciding the addition order is lost when the total addition amount of each element is less than 80%. Moreover, unless a given element needs to be added at two points in time for some reason, it is acceptable to add the total amount thereof at one time. It should be understood, however, that in order to enable final control of the content of the individual elements after all elements have been added, an amount of addition of each element that is less than 10% of the total amount to be added is excluded from the consideration of addition amount. One minute or more is preferably allowed to pass between the addition times of the individual elements. The time allowed to pass is preferably 2 minutes or more and still more preferably 3 minutes or more. The steel is cast within 60 minutes after all of the elements have been added, preferably within 40 minutes, and still more preferably within 20 minutes. The effect of the invention is more pronounced when, in the continuous casting, the cooling rate during solidification at a slab-thickness direction layer measuring ¼ the slab thickness is not greater than 10° C./sec, preferably not greater than 5° C./sec, still more preferably not less than 2° C./sec, still more preferably not less than 1° C./sec, still more preferably not less than 0.5° C./sec, and most preferably not greater than 0.1° C./sec. Although the invention does not place any particular lower limit on the cooling rate, the lower limit taking productivity into account is 0.01° C./sec.

The mechanism by which the foregoing steelmaking conditions affect the characteristics of the invention steel is believed to be as follows. The composite oxide compositional variation of the invention steel is produced primarily by thermodynamic compositional variation of oxides occurring during solidification of the molten steel. and is basically manifested utilizing the non-equilibrium state during the process in which the oxide compositions approach a state of equilibrium owing to changes in system concentration and temperature. When an element A having weak deoxidizing capability is added first, the oxygen in the steel forms coarse A oxide, but when an element B having strong bonding force with oxygen is then added, element A in the A oxide is replaced by element B. Coarse A-B composite oxide is formed during this process. If the element with the stronger deoxidizing capability should be added first, the complexing process would not occur readily thereafter. What is more, a large amount of oxide would be formed simultaneously with the addition and the oxides would float and be deoxidized, making it hard to disperse oxides in the steel and thus reducing the effect of enhancing the product fishscale resistance. This being the mechanism, some amount of time is required between the addition of the weak deoxidizing element and formation of the coarse composite oxides, but if too long a period passes after the addition, the composition of the A-B composite oxide too closely approaches B oxide as the equilibrium state, so that not only is the effect of the composite oxide diminished but the oxides also float and pass outside the molten steel, whereby the characteristic enhancing effect is inhibited.

There is no need to adopt a complicated addition schedule and the purpose can be achieved by adding most of the total amount to be added at one time, so addition of 80% or greater is defined as a target. It is of course also possible to bring out the effect of the invention still more prominently by adopting a complex addition schedule for controlling the form of the composite oxide compositional variation by dividing the addition of each element into a number of times. The aforesaid variation in oxide composition is not caused solely by compositional variation owing to element addition and/or passage of time but is also strongly related to temperature. Temperature-based reaction control from after completion of element addition to the beginning of solidification is especially important. Particularly when the steel is changing from liquid to solid, the solubility of the elements in the steel changes greatly to have no small effect on compositional variation. The cooling rate at the solidification point is therefore important to thorough achievement of the invention effect. If too fast, element replacement becomes inadequate and the effect of the invention comes to be inhibited by the formation of fine oxides and precipitates separately of the original coarse composite oxides. If the cooling is too gradual, the effect of the invention is diminished owing to compositional homogenization, and productivity also declines. Since the cooling rate of a steel slab during casting varies with location in the slab thickness direction, the cooling rate at a slab-thickness direction layer measuring ¼ the slab thickness is defined as the representative value in the present invention. The cooling rate at the ¼ layer is determined by a heat conduction calculation that is generally recognized and used in operational control and the like.

When the composite oxides of interest in the present invention have an average diameter of 1.0 μm or greater at the time solidification of the cast slab is completed, the effect of the invention can be strikingly achieved. The average diameter is preferably 4.0 μm or greater, more preferably 10 μm or greater, still more preferably 15 μm or greater, and most preferably 20 μm or greater. It is believed that it is preferable for the oxides to be coarse at the completion of casting because if fine, the oxides come to be poor in elongation property at the time of steel slab processing and, in addition, fracture does not occur readily. What is defined here is the average diameter, and the measurement is ordinarily done on composite oxides of around a size that can be observed with an optical microscope or low-magnification scanning electron microscope.

In the ordinary steel sheet production process, the rolling elongates and fractures these composite oxides into a form preferable for realizing the desired characteristics. Some amount of working is required for this, so that the thickness of the cast steel slab is preferably 50 mm or greater. From the standpoint of the operating conditions, the upper limit of thickness is preferably made not greater than 300 mm.

In the production process, the thickness is reduced to around 1 to 8 mm by hot rolling and further to around 2 to 0.2 mm by cold rolling, so that the total strain expressed as logarithmic strain ranges from 3 to 5 or greater. Moreover, in order to realize good fishscale property, it is effective during hot rolling conducted at 600° C. or greater to first conduct rolling under conditions of 1000° C. or greater and strain rate of 1/sec or greater to a total true strain of 0.4 or greater and then conduct rolling under conditions of 1000° C. or less and strain rate of 10/sec or greater to a total true strain of 0.7 or greater. This is considered to be because it enables control of the formation process of the composite oxides of differing composition present in the steel and the voids that accompany them, thereby making it possible to obtain composite oxides and voids of preferable form and properties.

Although no upper limit is particularly defined for the total true strain, in view of the limitation on actual rolling capability, it is 100 under conditions of 1000° C. or greater and strain rate of 1/sec or greater and 150 under conditions of 1000° C. or less and strain rate of 10/sec or greater.

Although it is not altogether clear, the mechanism exhibited by the present invention will explained in the following. The voids functioning as hydrogen trapping sites are mainly formed by the fracturing of the complex oxides in the cold rolling process after the hot rolling, but in the hot rolling process that precedes, control of the shape of the complex oxides is vital. More specifically, in the hot rolling process, since the temperature is high, the complex oxides also soften, so that difference in hardness from the matrix phase, that is, the iron, becomes small. In the temperature range of approximately 1000° C. or greater, the rolling causes almost no fracturing of the complex oxides and the complex oxides are merely elongated. Further, when the temperature is lower than 1000° C. and becomes approximately 900° C. or less, the complex oxides become difficult to elongate, but no pronounced fracturing such as that in cold rolling occurs and only local cracking occurs to the extent of fine crack occurrence. In order to obtain such suitably elongated composite oxides simultaneously formed with fine cracks prior to cold rolling, it is essential to control the temperature during hot rolling, control the amount of strain in each temperature zone, and further control the strain rate so as to give rise to marked recovery of the base metal and composite oxides deformed owing to the high-temperature working.

If the temperature range of the hot working is too high, the recovery cannot impart enough strain to the composite oxides to cause intense crack formation. If too low, the complex oxides do not assume an extended form but become nearly spherical, thus making invasion of cracks difficult. Suitable elongation and reduced thickness are required for formation of cracks. For this, control needs to be conducted during hot rolling so as to elongate the composite oxides by suitable deformation in the higher temperature zone and to form and introduce cracks in the lower temperature zone. Moreover, as pointed out earlier, in the case where the composite oxides in which such cracks are to be formed contain differences in deformability owing to the presence of concentration differences therein, the form of the composite oxides becomes complex to enable efficient formation of effective voids.

The hot rolling heating temperature, the coiling temperature, etc. can be set in the ranges of ordinary operation as usual. The hot rolling heating temperature may be 1000° C. or less, but if rolling is to be conducted at 1000° C. or greater so as to obtain the full effect of the complex oxide elongation by the hot rolling, the heating temperature should be 1050 to 1300° C. and the coiling temperature 400 to 800° C.

The cold rolling is preferably performed at a cold rolling reduction of 60% or greater so as to thoroughly fracture of the complex oxides and obtain a steel sheet with good deep drawability. Particularly when deep drawability is required, a cold rolling reduction of 75% or greater is preferable.

The annealing may be box annealing or continuous annealing. The features of the present invention remain the same. The features of the present invention are exhibited so long as the annealing temperature is equal to or higher than the recrystallization temperature. To bring out the features of the present invention such as excellent deep drawability and good enameling characteristics, continuous annealing is particularly preferable. Box annealing can be performed mainly at 650 to 750° C., while continuous annealing can be performed mainly at 700 to 890° C.

As explained in the foregoing, the steel sheet controlled in compositional variation of the composite oxides as in the present invention has very good fishscale resistance not only in direct one-coat enameling but also in two-coat enameling. Further, no bubbles, black spot defects, etc. occur and an enameling steel sheet with excellent enamel adhesion is obtained. The method of glaze application is not limited to wet glazing, and enameling using a dry powder can also be utilized with no problem. Moreover, there is no limitation whatsoever on applications and the like. The invention exhibits its characteristic features when applied to bathtubs, tableware, kitchen utensils, building materials, household electrical appliance panels, and other products falling in the technical category of enameled steel sheet.

EXAMPLES

The present invention will now be explained in detail based on examples.

Continuously cast slabs having various chemical compositions were hot rolled, cold rolled, and annealed under various production conditions. Next, they were temper rolled at a reduction of 1.0% and then examined for enameling characteristics. The compositions, production conditions, and examination results are shown in Tables 1 to 3. Specifically, Table 1-1 to Table 1-3 show the steel compositions, Table 2-1 to Table 2-3 show the slab production conditions from steelmaking through casting and the hot rolling conditions, and Table 3-1 to Table 3-3 show the conditions in annealing after cold rolling, the Nb and Mn contents of the oxides in the obtained steel sheets, and the enameling properties of the steel sheets.

Note that in the "Rolling" columns of Table 2-1 to Table 2-3, A indicates the total true strain imparted at 1000° C. or greater and a strain rate of 1/sec or greater and B indicates the total true strain imparted at 1000° C. or less and a strain rate of 10/sec or greater. Further, in the "Separate oxides" columns of Table 3-1 to Table 3-3, A, B and C show the relative positions of the oxides for which high concentration/low concentration ratios are shown, where A indicates an angle of within ±5° and a distance within 0.5 μm, B indicates that A condition is not met, with the angle being within ±10° and distance within 20 μm, and C indicates that B condition is not met. "Oxides" here means composite oxides formed of Fe, Si, Mn, Al, Nb, V, B and the like that have combined and consolidated. "Separate oxides" means any two complex oxides not contacting each other. "Same oxide" means any single oxide that is not separated. In the "Bubble/Black spot defect resistance" column under "Enamel characteristics," A means Outstandingly excellent, B means Excellent, C means Fair, D means Marginally inferior, E means Problematic, and in the "Fishscale resistance" column, A means Outstandingly excellent, B means Excellent, C means Marginally excellent, D means Fair and E means Problematic.

In the Examples, steels intended to have the same composition came to have slightly different compositions as the result of a study done on the effect of the element addition conditions during steelmaking. These steels were nevertheless compared in characteristics as steels having identical compositions. Steels judged to have identical compositions were assigned the same letter of the alphabet. The steels assigned the same letter were numbered consecutively and examined for the effect of the production conditions.

The enameling was performed using the powder electrostatic coating method to dry coat an underglaze to 100 μm and an overglaze to 100 μm, and firing at 850° C. for 3 minutes in an atmosphere having a dew point of 60° C.

The fired sheet was placed in a 160° C. constant temperature bath for 10 hours to conduct an accelerated fishscale test, whereafter the occurrence of fishscale was visually observed and rated on a five-point scale of A to E, with A defined as Best, D as Fair and E as Poor.

The surface characteristics, namely bubbles and black spot defects, were visually examined and rated on a five-point scale of A to E, with A defined as Best, C as Fair and E as Worst.

Since no difference in enamel adhesion was shown by the ordinarily used P.E.I. adhesion test method (ASTM C313-59), evaluation was conducted by dropping a 2 kg spherical weight from 1 meter height, measuring the state of peeling of enamel at the deformed part with 169 contact probes, and determining the area ratio of the unpeeled parts.

As clear from the results shown in Tables 1 to 3, the steel sheets satisfying the compositions and content ranges defined by the present invention were enameling steel sheets that were extraordinarily excellent in enameling properties, particularly fishscale resistance. Of particular note is that when the concentration differences of the composite oxides were controlled under the control of a production method in which the order of addition was Mn→Nb and 80% or more of the total amount of Mn was added first, 1 minute or more was allowed to pass, 80% or more of the total amount of Nb was added, and continuous casting was conducted within a period of 60 minutes (Examples designated by steel code: a1 to a4, b1 to b6, c1, c2, d1, d3, e1, f1, g1, h1, i1, j1, k1 and l1), the effect of enameling properties improvement was most evident, as can be seen in Table 3-1 and Table 3-2.

Moreover, the steel sheets that satisfied the compositions and content ranges defined by the present invention exhibited excellent enameling properties even when no particular control of the production method or control of the composite oxide concentration differences was conducted, although the their enameling properties were inferior to those mentioned above. Examples thereof are (designated by steel code) a5 to a7, b7, b8, c3, c4, d2 and d4 to d7.

In contrast, as indicated in Table 1-3, Table 2-3 and Table 3-3, the enameling properties were inferior in Comparative Examples (designated by steel code) l2 having high Ni content, m1 and m2 having high Cu content, n1 and n2 having high B content, o1, o2, p1 and p2 having low Nb content, and q2, r1 and r2 having high Al content. As set out in Table 2-3, all of these examples were controlled in composite oxide concentration difference in accordance with the described aspects of the production method, including the order of Mn and Nb addition. However, as shown in Table 3-3, l2, m1, m2, n1 and n2, all of which had high Ni, Cu or B content, were all somewhat inferior in characteristics but still usable in enameled products. On the other hand, o1, o2, p1, p2, q1, q2, r1 and r2, all of which had high low Nb or high Al content, all failed to meet the enameling property standard.

The foregoing Example results demonstrate that the enameling steel sheets of the present invention are excellent in fishscale resistance, bubble/black spot defect resistance and enamel adhesion, and thus satisfy all enameling properties required by an enameling steel sheet. Owing to the marked improvement in fishscale resistance and the quantum decline in reject ratio in the enamel product production process, the industrial significance is particularly great.

TABLE 1-1

| Steel | Composition (mass %) | | | | | | | | | | | | |
|---|---|---|---|---|---|---|---|---|---|---|---|---|---|
| code | C | Si | Mn | P | S | Al | N | Nb | V | B | O | Cu | Other elements |
| a1 | 0.0015 | 0.005 | 0.38 | 0.005 | 0.032 | 0.0015 | 0.0025 | 0.056 | — | — | 0.022 | — | — |
| a2 | 0.0015 | 0.005 | 0.38 | 0.005 | 0.032 | 0.0015 | 0.0025 | 0.056 | — | — | 0.022 | — | — |
| a3 | 0.0014 | 0.005 | 0.38 | 0.005 | 0.030 | 0.0012 | 0.0024 | 0.056 | — | — | 0.023 | — | — |
| a4 | 0.0016 | 0.005 | 0.38 | 0.005 | 0.029 | 0.0012 | 0.0027 | 0.056 | — | — | 0.023 | — | — |
| a5 | 0.0015 | 0.005 | 0.38 | 0.006 | 0.030 | 0.0017 | 0.0025 | 0.055 | — | — | 0.020 | — | — |
| a6 | 0.0015 | 0.005 | 0.37 | 0.009 | 0.030 | 0.0020 | 0.0025 | 0.059 | — | — | 0.020 | — | — |
| a7 | 0.0015 | 0.005 | 0.37 | 0.009 | 0.030 | 0.0020 | 0.0025 | 0.059 | — | — | 0.020 | — | — |
| b1 | 0.0007 | 0.002 | 0.25 | 0.007 | 0.0005 | 0.0027 | 0.0017 | 0.082 | — | — | 0.040 | 0.004 | — |
| b2 | 0.0006 | 0.004 | 0.25 | 0.007 | 0.0009 | 0.0025 | 0.0016 | 0.087 | — | — | 0.033 | 0.005 | — |
| b3 | 0.0008 | 0.002 | 0.25 | 0.008 | 0.0008 | 0.0025 | 0.0020 | 0.085 | — | — | 0.033 | 0.005 | — |
| b4 | 0.0006 | 0.002 | 0.25 | 0.007 | 0.0006 | 0.0025 | 0.0016 | 0.082 | — | — | 0.036 | 0.002 | — |
| b5 | 0.0007 | 0.003 | 0.25 | 0.007 | 0.0005 | 0.0030 | 0.0016 | 0.082 | — | — | 0.033 | 0.003 | — |
| b6 | 0.0007 | 0.003 | 0.25 | 0.007 | 0.0005 | 0.0030 | 0.0016 | 0.082 | — | — | 0.033 | 0.003 | — |
| b7 | 0.0008 | 0.003 | 0.30 | 0.007 | 0.0010 | 0.0035 | 0.0022 | 0.077 | — | — | 0.025 | 0.003 | — |
| b8 | 0.0008 | 0.003 | 0.30 | 0.007 | 0.0010 | 0.0035 | 0.0022 | 0.077 | — | — | 0.025 | 0.003 | — |
| c1 | 0.0009 | 0.035 | 0.56 | 0.003 | 0.058 | 0.0037 | 0.0007 | 0.145 | — | 0.0015 | 0.014 | — | — |
| c2 | 0.0009 | 0.035 | 0.56 | 0.003 | 0.058 | 0.0037 | 0.0007 | 0.145 | — | 0.0015 | 0.014 | — | — |
| c3 | 0.0009 | 0.035 | 0.56 | 0.003 | 0.058 | 0.0037 | 0.0007 | 0.145 | — | 0.0015 | 0.014 | — | — |
| c4 | 0.0010 | 0.035 | 0.57 | 0.005 | 0.058 | 0.0048 | 0.0014 | 0.122 | — | 0.0013 | 0.012 | — | — |
| d1 | 0.0012 | 0.007 | 0.04 | 0.011 | 0.044 | 0.0006 | 0.0043 | 0.072 | 0.038 | — | 0.022 | — | — |
| d2 | 0.0012 | 0.007 | 0.04 | 0.011 | 0.044 | 0.0006 | 0.0043 | 0.072 | 0.038 | — | 0.022 | — | — |

TABLE 1-1-continued

| Steel | Composition (mass %) | | | | | | | | | | | | |
|---|---|---|---|---|---|---|---|---|---|---|---|---|---|
| code | C | Si | Mn | P | S | Al | N | Nb | V | B | O | Cu | Other elements |
| d3 | 0.0012 | 0.008 | 0.04 | 0.011 | 0.044 | 0.0009 | 0.0033 | 0.072 | 0.038 | — | 0.022 | — | — |
| d4 | 0.0012 | 0.008 | 0.04 | 0.011 | 0.044 | 0.0009 | 0.0033 | 0.072 | 0.038 | — | 0.022 | — | — |
| d5 | 0.0014 | 0.007 | 0.04 | 0.011 | 0.044 | 0.0006 | 0.0035 | 0.072 | 0.035 | — | 0.020 | — | — |
| d6 | 0.0013 | 0.008 | 0.06 | 0.011 | 0.044 | 0.0010 | 0.0035 | 0.068 | 0.040 | — | 0.020 | — | — |
| d7 | 0.0013 | 0.008 | 0.04 | 0.011 | 0.040 | 0.0007 | 0.0035 | 0.074 | 0.033 | — | 0.023 | — | — |

TABLE 1-2

| Steel | Composition (mass %) | | | | | | | | | | | | |
|---|---|---|---|---|---|---|---|---|---|---|---|---|---|
| code | C | Si | Mn | P | S | Al | N | Nb | V | B | O | Cu | Other elements |
| e1 | 0.0019 | 0.013 | 0.31 | 0.021 | 0.021 | 0.0075 | 0.0037 | 0.074 | — | — | 0.048 | 0.009 | — |
| e2 | 0.0020 | 0.013 | 0.31 | 0.020 | 0.018 | 0.0088 | 0.0027 | 0.075 | — | — | 0.045 | 0.005 | — |
| f1 | 0.0016 | 0.004 | 0.43 | 0.005 | 0.036 | 0.0029 | 0.0020 | 0.061 | 0.048 | — | 0.026 | — | — |
| f2 | 0.0016 | 0.005 | 0.42 | 0.005 | 0.036 | 0.0029 | 0.0022 | 0.061 | 0.038 | — | 0.024 | — | — |
| g1 | 0.0010 | 0.005 | 0.28 | 0.008 | 0.033 | 0.0025 | 0.0024 | 0.086 | — | — | 0.037 | 0.022 | Cr: 0.011<br>Ni: 0.023 |
| h1 | 0.0024 | 0.024 | 0.88 | 0.004 | 0.026 | 0.0018 | 0.0020 | 0.212 | 0.011 | — | 0.062 | — | Sn: 0.008<br>Ca: 0.005<br>Sb: 0.004 |
| I1 | 0.0004 | 0.003 | 0.26 | 0.026 | 0.016 | 0.0011 | 0.0022 | 0.106 | — | 0.0009 | 0.019 | 0.033 | La: 0.056<br>Ce: 0.022 |
| j1 | 0.0072 | 0.005 | 0.15 | 0.004 | 0.036 | 0.0011 | 0.0014 | 0.113 | — | — | 0.043 | — | Mo: 0.029<br>W: 0.007<br>Ta: 0.005 |
| k1 | 0.0029 | 0.003 | 0.13 | 0.010 | 0.041 | 0.0029 | 0.0014 | 0.122 | — | — | 0.033 | — | Ti: 0.012 |
| l1 | 0.0026 | 0.004 | 0.22 | 0.005 | 0.008 | 0.0022 | 0.0020 | 0.078 | — | — | 0.044 | — | Ni: 0.035<br>Mg: 0.006 |

TABLE 1-3

| Steel code | Composition (mass %) | | | | | | | | | | | | |
|---|---|---|---|---|---|---|---|---|---|---|---|---|---|
| | C | Si | Mn | P | S | Al | N | (b | V | B | O | Cu | Other elements |
| l2 | 0.0028 | 0.004 | 0.22 | 0.005 | 0.008 | 0.0018 | 0.0021 | 0.080 | — | — | 0.040 | — | Ni: 0.23<br>Mg: 0.011 |
| m1 | 0.0012 | 0.013 | 0.30 | 0.005 | 0.022 | 0.0011 | 0.0021 | 0.088 | — | — | 0.035 | 0.250 | As: 0.001<br>Se: 0.002 |
| m2 | 0.0012 | 0.010 | 0.30 | 0.005 | 0.022 | 0.0011 | 0.0021 | 0.086 | — | — | 0.028 | 0.850 | As: 0.001<br>Se: 0.002 |
| n1 | 0.0022 | 0.004 | 0.28 | 0.013 | 0.035 | 0.0011 | 0.0028 | 0.091 | 0.025 | 0.0035 | 0.015 | — | |
| n2 | 0.0025 | 0.004 | 0.28 | 0.014 | 0.035 | 0.0011 | 0.0028 | 0.091 | 0.025 | 0.0035 | 0.014 | — | Ni: 0.046 |
| o1 | 0.0009 | 0.014 | 0.45 | 0.008 | 0.022 | 0.0033 | 0.0030 | 0.045 | 0.033 | — | 0.020 | — | |
| o2 | 0.0009 | 0.014 | 0.43 | 0.008 | 0.022 | 0.0033 | 0.0030 | 0.039 | 0.031 | — | 0.015 | — | |
| p1 | 0.0024 | 0.004 | 0.21 | 0.005 | 0.025 | 0.0035 | 0.0009 | 0.033 | 0.045 | — | 0.048 | 0.024 | |
| p2 | 0.0024 | 0.004 | 0.20 | 0.005 | 0.024 | 0.0035 | 0.0010 | 0.030 | 0.045 | — | 0.033 | 0.024 | |
| q1 | 0.0012 | 0.014 | 0.35 | 0.008 | 0.041 | 0.0460 | 0.0024 | — | — | — | 0.008 | 0.031 | Ti: 0.058 |
| q2 | 0.0012 | 0.014 | 0.35 | 0.008 | 0.041 | 0.0460 | 0.0024 | — | — | — | 0.008 | 0.031 | Ti: 0.058 |
| r1 | 0.0014 | 0.008 | 0.25 | 0.006 | 0.007 | 0.0110 | 0.0023 | — | — | 0.0016 | 0.038 | — | |
| r2 | 0.0014 | 0.008 | 0.25 | 0.006 | 0.007 | 0.0110 | 0.0023 | — | — | 0.0016 | 0.038 | — | |

TABLE 2-1

| | Steelmaking (Casting) | | | | | | | Slab | | Hot rolling | | | |
|---|---|---|---|---|---|---|---|---|---|---|---|---|---|
| | | Initial addition amount | | | Time | Cooling | | | | | | | |
| Steel code | Mn, Nb addition order | Mn | Nb | Addition interval (min) | after addition (min) | at solidification (° C./sec) | Thickness (mm) | Oxide diameter (μm) | Slab heating (° C.) | Rolling A | Rolling B | Finish temp (° C.) | Coiling temp (° C.) |
| a1 | Mn→Nb | 100 | 100 | 10 | 5 | 1.0 | 250 | 100 | 1200 | 1.7 | 1.6 | 880 | 660 |
| a2 | Mn→Nb | 100 | 100 | 10 | 10 | 0.5 | 250 | 60 | 1200 | 1.7 | 1.6 | 880 | 660 |
| a3 | Mn→Nb | 100 | 100 | 10 | 10 | 1.0 | 250 | 60 | 1200 | 1.7 | 1.6 | 880 | 660 |
| a4 | Mn→Nb | 100 | 100 | 1 | 10 | 1.0 | 250 | 10 | 1200 | 1.7 | 1.6 | 880 | 660 |

TABLE 2-1-continued

| Steel code | Steelmaking (Casting): Mn, Nb addition order | Initial addition amount Mn | Initial addition amount Nb | Addition interval (min) | Time after addition (min) | Cooling at solidification (° C./sec) | Slab Thickness (mm) | Slab Oxide diameter (μm) | Hot rolling Slab heating (° C.) | Rolling A | Rolling B | Finish temp (° C.) | Coiling temp (° C.) |
|---|---|---|---|---|---|---|---|---|---|---|---|---|---|
| a5 | Simultaneous | 100 | 100 | — | 10 | 1.0 | 250 | 5 | 1200 | 1.7 | 1.6 | 880 | 660 |
| a6 | Nb→Mn | 100 | 100 | 10 | 5 | 1.0 | 250 | 30 | 1200 | 1.7 | 1.6 | 880 | 660 |
| a7 | Nb→Mn | 100 | 100 | 1 | 10 | 0.5 | 250 | 15 | 1200 | 1.7 | 1.6 | 880 | 660 |
| b1 | Mn→Nb | 90 | 90 | 60 | 30 | 2.0 | 200 | 180 | 1100 | 0.9 | 2.3 | 920 | 740 |
| b2 | Mn→Nb | 90 | 90 | 30 | 30 | 2.0 | 200 | 120 | 1100 | 0.9 | 2.3 | 920 | 740 |
| b3 | Mn→Nb | 90 | 90 | 15 | 30 | 2.0 | 200 | 50 | 1100 | 0.9 | 2.3 | 920 | 740 |
| b4 | Mn→Nb | 90 | 90 | 5 | 30 | 2.0 | 200 | 20 | 1100 | 0.9 | 2.3 | 920 | 740 |
| b5 | Mn→Nb | 90 | 90 | 3 | 30 | 2.0 | 200 | 5 | 1100 | 0.9 | 2.3 | 920 | 740 |
| b6 | Mn→Nb | 90 | 90 | 3 | 30 | 0.2 | 200 | 2 | 1100 | 0.9 | 2.3 | 920 | 740 |
| b7 | Nb→Mn | 90 | 90 | 20 | 5 | 2.0 | 200 | 20 | 1100 | 0.9 | 2.3 | 920 | 740 |
| b8 | Nb→Mn | 90 | 90 | 3 | 30 | 2.0 | 200 | 2 | 1100 | 0.9 | 2.3 | 920 | 740 |
| c1 | Mn→Nb | 70 | 100 | 30 | 20 | 5.0 | 100 | 50 | 1150 | 0.6 | 1.9 | 850 | 750 |
| c2 | Mn→Nb | 70 | 100 | 30 | 50 | 5.0 | 100 | 20 | 1150 | 0.6 | 1.9 | 850 | 750 |
| c3 | Mn→Nb | 70 | 100 | 30 | 90 | 5.0 | 100 | 50 | 1150 | 0.6 | 1.9 | 850 | 750 |
| c4 | Simultaneous | 70 | 100 | — | 20 | 5.0 | 100 | 5 | 1150 | 0.6 | 1.9 | 850 | 750 |
| d1 | Mn→Nb | 100 | 100 | 20 | 60 | 1.0 | 200 | 90 | 1250 | 1.3 | 2.8 | 940 | 700 |
| d2 | Mn→Nb | 100 | 100 | 20 | 120 | 1.0 | 200 | 40 | 1250 | 1.3 | 2.8 | 940 | 700 |
| d3 | Mn→Nb | 100 | 100 | 5 | 60 | 1.0 | 200 | 20 | 1250 | 1.3 | 2.8 | 940 | 700 |
| d4 | Mn→Nb | 100 | 100 | 5 | 120 | 1.0 | 200 | 40 | 1250 | 1.3 | 2.8 | 940 | 700 |
| d5 | Simultaneous | 100 | 100 | — | 60 | 1.0 | 200 | 5 | 1250 | 1.3 | 2.8 | 940 | 700 |
| d6 | Nb→Mn | 100 | 100 | 20 | 10 | 1.0 | 200 | 2 | 1250 | 1.3 | 2.8 | 940 | 700 |
| d7 | Nb→Mn | 100 | 100 | 5 | 10 | 1.0 | 200 | 20 | 1250 | 1.3 | 2.8 | 940 | 700 |

A: 1000° C. or greater and total true strain imparted at strain rate of 1/sec or greater
B: 1000° C. or less and total true strain imparted at strain rate of 10/sec or greater

TABLE 2-2

| Steel code | Steelmaking (Casting): Mn, Nb addition order r | Initial addition amount Mn | Initial addition amount Nb | Addition interval (min) | Time after addition (min) | Cooling at solidification (° C./sec) | Slab Thickness (mm) | Slab Oxide diameter (μm) | Hot rolling Slab heating (° C.) | Rolling A | Rolling B | Finish temp (° C.) | Coiling temp (° C.) |
|---|---|---|---|---|---|---|---|---|---|---|---|---|---|
| e1 | Mn→Nb | 80 | 80 | 20 | 5 | 0.3 | 250 | 40 | 1050 | 1.8 | 1.0 | 960 | 780 |
| e2 | Nb→Mn | 80 | 80 | 20 | 5 | 0.3 | 250 | 1 | 1050 | 1.8 | 1.0 | 960 | 780 |
| f1 | Mn→Nb | 100 | 100 | 5 | 30 | 15 | 50 | 30 | 1150 | 0.3 | 1.8 | 900 | 670 |
| f2 | Nb→Mn | 100 | 100 | 5 | 30 | 15 | 50 | 5 | 1150 | 0.3 | 1.8 | 900 | 670 |
| g1 | Mn→Nb | 100 | 100 | 1 | 20 | 0.1 | 300 | 20 | 1100 | 2.4 | 1.6 | 840 | 710 |
| h1 | Mn→Nb | 50 | 90 | 1 | 40 | 0.5 | 250 | 30 | 1100 | 1.0 | 3.2 | 800 | 590 |
| i1 | Mn→Nb | 100 | 100 | 60 | 40 | 2.0 | 250 | 10 | 1000 | — | 1.3 | 900 | 740 |
| j1 | Mn→Nb | 80 | 80 | 10 | 30 | 0.5 | 200 | 20 | 1100 | 1.2 | 0.5 | 820 | 600 |
| k1 | Mn→Nb | 100 | 100 | 10 | 30 | 1.0 | 200 | 40 | 1050 | 0.4 | 1.4 | 870 | 730 |
| l1 | Mn→Nb | 90 | 90 | 10 | 10 | 1.0 | 200 | 20 | 1150 | 1.6 | 2.3 | 890 | 700 |

A: 1000° C. or greater and total true strain imparted at strain rate of 1/sec or greater
B: 1000° C. or less and total true strain imparted at strain rate of 10/sec or greater

TABLE 2-3

| Steel code | Steelmaking (Casting): Mn, Nb addition order r | Initial addition amount Mn | Initial addition amount Nb | Addition interval (min) | Time after addition (min) | Cooling at solidification (° C./sec) | Slab Thickness (mm) | Slab Oxide diameter (μm) | Hot rolling Slab heating (° C.) | Rolling A | Rolling B | Finish temp (° C.) | Coiling temp (° C.) |
|---|---|---|---|---|---|---|---|---|---|---|---|---|---|
| l2 | Mn→Nb | 90 | 90 | 10 | 10 | 1.0 | 200 | 5 | 1150 | 1.6 | 2.3 | 890 | 700 |
| m1 | Mn→Nb | 90 | 90 | 10 | 10 | 1.0 | 250 | 30 | 1150 | 1.0 | 1.6 | 920 | 700 |
| m2 | Mn→Nb | 90 | 90 | 10 | 10 | 1.0 | 250 | 30 | 1150 | 1.0 | 1.6 | 920 | 700 |
| n1 | Mn→Nb | 90 | 90 | 10 | 10 | 1.0 | 200 | 20 | 1150 | 1.6 | 2.3 | 890 | 700 |
| n2 | Mn→Nb | 90 | 90 | 10 | 10 | 1.0 | 200 | 5 | 1150 | 1.6 | 2.3 | 890 | 700 |
| o1 | Mn→Nb | 90 | 90 | 10 | 10 | 0.5 | 250 | 10 | 1150 | 1.0 | 1.6 | 900 | 730 |

TABLE 2-3-continued

| Steel code | Steelmaking (Casting): Mn, Nb addition order r | Initial addition amount: Mn | Initial addition amount: Nb | Addition interval (min) | Time after addition (min) | Cooling at solidification (° C./sec) | Slab: Thickness (mm) | Slab: Oxide diameter (μm) | Hot rolling: Slab heating (° C.) | Rolling: A | Rolling: B | Finish temp (° C.) | Coiling temp (° C.) |
|---|---|---|---|---|---|---|---|---|---|---|---|---|---|
| o2 | Simultaneous | 90 | 90 | — | 30 | 0.5 | 250 | 10 | 1150 | 1.0 | 1.6 | 900 | 730 |
| p1 | Mn→Nb | 90 | 90 | 10 | 20 | 1.0 | 200 | 70 | 1150 | 1.6 | 2.3 | 890 | 700 |
| p2 | Simultaneous | 90 | 90 | — | 60 | 1.0 | 200 | 20 | 1150 | 1.6 | 2.3 | 890 | 700 |
| q1 | — | 100 | — | — | 10 | 0.5 | 250 | 10 | 1150 | 1.0 | 1.6 | 920 | 730 |
| q2 | — | 100 | — | — | 30 | 0.5 | 250 | 10 | 1150 | 1.0 | 1.6 | 920 | 730 |
| r1 | — | 100 | — | — | 40 | 1.0 | 250 | 30 | 1100 | 1.5 | 1.2 | 900 | 700 |
| r2 | — | 100 | — | — | 40 | 10 | 100 | 2 | 1100 | 0.7 | 1.2 | 860 | 680 |

A: 1000° C. or greater and total true strain imparted at strain rate of 1/sec or greater B: 1000° C. or less and total true strain imparted at strain rate of 10/sec or greater

TABLE 3-1

| Steel code | Cold rolling Reduction (%) | Annealing Temp (° C.) | Annealing Time (min) | Max ratio (separate oxides) Nb | Max ratio (separate oxides) Mn | Separate oxide distribution Nb | Separate oxide distribution Mn | Max ratio (in same oxide) Nb | Max ratio (in same oxide) Mn | Enameling properties: Bubble/Black spot resistance | Enameling properties: Adhesion % | Enameling properties: Fishscale resistance | Enameling properties: Remark |
|---|---|---|---|---|---|---|---|---|---|---|---|---|---|
| a1 | 73 | 890 | 2 | 4.3 | 2.2 | A | A | 2.5 | 2.0 | A | 100 | A | Invention |
| a2 | 73 | 890 | 2 | 1.5 | 1.8 | B | B | 1.1 | 1.5 | A | 90 | A | |
| a3 | 73 | 890 | 2 | 2.2 | 2.0 | A | A | 2.2 | 1.4 | A | 95 | A | |
| a4 | 73 | 890 | 2 | 1.8 | 2.1 | A | A | 1.6 | 1.4 | A | 90 | A | |
| a5 | 73 | 890 | 2 | 1.1 | 1.2 | C | C | 1.1 | 1.2 | A | 85 | B | |
| a6 | 73 | 890 | 2 | 1.1 | 1.1 | C | C | 1.1 | 1.1 | B | 80 | C | |
| a7 | 73 | 890 | 2 | 1.1 | 1.0 | C | C | 1.0 | 1.0 | B | 75 | C | |
| b1 | 80 | 830 | 1 | 1.4 | 1.7 | C | B | 1.2 | 1.5 | A | 80 | B | |
| b2 | 80 | 830 | 1 | 1.9 | 1.7 | B | B | 1.5 | 1.3 | A | 90 | A | |
| b3 | 80 | 830 | 1 | 3.5 | 2.7 | A | A | 1.4 | 2.0 | A | 100 | A | |
| b4 | 80 | 830 | 1 | 8.5 | 5.7 | A | A | 2.5 | 4.0 | A | 100 | A | |
| b5 | 80 | 830 | 1 | 2.5 | 4.0 | A | A | 1.2 | 2.5 | B | 90 | B | |
| b6 | 80 | 830 | 1 | 1.5 | 1.6 | A | B | 1.5 | 1.4 | B | 75 | B | |
| b7 | 80 | 830 | 1 | 1.0 | 1.1 | C | B | 1.0 | 1.1 | B | 80 | D | |
| b8 | 80 | 830 | 1 | 1.0 | 1.0 | C | C | 1.0 | 1.0 | C | 75 | C | |
| c1 | 88 | 850 | 0.5 | >10 | 5.2 | A | A | 5.9 | 3.1 | B | 75 | B | |
| c2 | 88 | 850 | 0.5 | 7.1 | 7.3 | A | A | 4.4 | 4.4 | A | 80 | B | |
| c3 | 88 | 850 | 0.5 | 2.2 | 3.0 | B | A | 2.0 | 1.6 | A | 85 | C | |
| c4 | 88 | 850 | 0.5 | 1.3 | 1.5 | C | B | 1.3 | 1.2 | B | 75 | C | |
| d1 | 80 | 750 | 1 | 3.1 | 4.1 | B | A | 2.0 | 1.7 | C | 90 | B | |
| d2 | 80 | 750 | 1 | 2.4 | 2.1 | A | B | 1.4 | 1.9 | C | 90 | C | |
| d3 | 80 | 750 | 1 | 1.8 | 1.6 | A | A | 1.5 | 1.4 | B | 85 | B | |
| d4 | 80 | 750 | 1 | 1.4 | 1.6 | A | A | 1.4 | 1.6 | C | 80 | C | |
| d5 | 80 | 750 | 1 | 1.2 | 1.1 | B | C | 1.2 | 1.1 | C | 75 | C | |
| d6 | 80 | 750 | 1 | 1.0 | 1.1 | C | C | 1.0 | 1.1 | B | 75 | D | |
| d7 | 80 | 750 | 1 | 1.1 | 1.1 | C | A | 1.1 | 1.1 | C | 75 | C | |

Separate oxide distribution

For oxide exhibiting high concentration/low concentration, relative position of

A: within ±5° and distance within 0.5 μm

B: A condition not met, with the angle being within ±10° and distance within 20 μm C: B condition not met Bubble/Black spot resistance A: Outstandingly excellent, B: Excellent, C: Fair, D: Marginally inferior, E: Problematic Fishscale resistance A: Outstandingly excellent, B: Excellent, C: Marginally excellent, D: Fair.

E: Problematic.

TABLE 3-2

| Steel code | Cold rolling Reduction (%) | Annealing Temp (° C.) | Annealing Time (min) | Max ratio (separate oxides) Nb | Max ratio (separate oxides) Mn | Separate oxide distribution Nb | Separate oxide distribution Mn | Max ratio (in same oxide) Nb | Max ratio (in same oxide) Mn | Enameling properties: Bubble/Black spot resistance | Enameling properties: Adhesion % | Enameling properties: Fishscale resistance | Remark |
|---|---|---|---|---|---|---|---|---|---|---|---|---|---|
| e1 | 93 | 870 | 1 | 2.5 | 2.0 | B | A | 2.2 | 1.8 | A | 100 | A | Invention |
| e2 | 93 | 870 | 1 | 1.1 | 1.3 | C | B | 1.1 | 1.2 | B | 75 | C | |
| f1 | 75 | 800 | 1 | 4.0 | 3.5 | A | A | 1.5 | 2.8 | C | 95 | B | |
| f2 | 75 | 800 | 1 | 1.3 | 1.4 | B | B | 1.2 | 1.3 | C | 85 | C | |
| g1 | 80 | 830 | 1 | >10 | 2.5 | A | B | 3.6 | 1.5 | A | 80 | B | |
| h1 | 77 | 900 | 1 | 2.3 | 1.4 | A | C | 2.0 | 1.4 | B | 75 | A | |
| i1 | 80 | 780 | 1 | >10 | 2.4 | B | A | 3.0 | 1.5 | C | 80 | B | |
| j1 | 87 | 830 | 1 | >10 | 3.0 | A | B | 6.1 | 2.1 | A | 90 | B | |
| k1 | 85 | 770 | 1 | 5.0 | 1.9 | A | B | 1.4 | 1.1 | B | 80 | C | |
| l1 | 80 | 800 | 1 | 2.2 | 1.6 | A | B | 2.1 | 1.4 | B | 80 | B | |

Separate oxide distribution
For oxide exhibiting high concentration/low concentration, relative position of
A: within ±5° and distance within 0.5 μm
B: A condition not met, with the angle being within ±10° and distance within 20 μm
C: B condition not met
Bubble/Black spot resistance
A: Outstandingly excellent,
B: Excellent,
C: Fair,
D: Marginally inferior,
E: Problematic
Fishscale resistance
A: Outstandingly excellent,
B: Excellent,
C: Marginally excellent,
D: Fair.
E: Problematic

TABLE 3-3

| Steel code | Cold rolling Reduction (%) | Annealing Temp (° C.) | Annealing Time (min) | Max ratio (separate oxides) Nb | Max ratio (separate oxides) Mn | Separate oxide distribution Nb | Separate oxide distribution Mn | Max ratio (in same oxide) Nb | Max ratio (in same oxide) Mn | Enameling properties: Bubble/Black spot resistance | Enameling properties: Adhesion % | Enameling properties: Fishscale resistance | Remark |
|---|---|---|---|---|---|---|---|---|---|---|---|---|---|
| l2 | 80 | 800 | 1 | 1.4 | 1.1 | B | B | 1.4 | 1.1 | C | 85 | C | Invention |
| m1 | 87 | 840 | 1 | 3.3 | 2.1 | B | B | 3.0 | 1.9 | B | 70 | C | |
| m2 | 87 | 840 | 1 | 2.4 | 2.5 | B | B | 2.2 | 2.0 | C | 70 | C | |
| n1 | 80 | *880 | 1 | 2.0 | 1.4 | A | B | 2.0 | 1.3 | B | 80 | C | |
| n2 | 80 | *880 | 1 | 1.3 | 1.3 | B | C | 1.3 | 1.3 | C | 75 | B | |
| o1 | 87 | 850 | 1 | 3.0 | 1.2 | C | B | 2.5 | 1.1 | C | 70 | D | Comparative |
| o2 | 87 | 850 | 1 | 1.3 | 1.7 | C | B | 1.1 | 1.6 | D | 70 | D | |
| p1 | 80 | 830 | 1 | 2.6 | 1.4 | B | C | 2.3 | 1.4 | C | 70 | D | |
| p2 | 80 | 830 | 1 | 1.4 | 1.1 | C | C | 1.2 | 1.1 | D | 75 | D | |
| q1 | 87 | 850 | 1 | — | 2.0 | — | B | — | 2.0 | E | 65 | E | |
| q2 | 87 | 850 | 1 | — | 2.6 | — | B | — | 1.9 | E | 70 | E | |
| r1 | 80 | 780 | 1 | — | 1.3 | — | C | — | 1.1 | C | 80 | D | |
| r2 | 80 | 780 | 1 | — | 1.1 | — | C | — | 1.1 | C | 75 | D | |

Separate oxide distribution
For oxide exhibiting high concentration/low concentration, relative position of
A: within ±5° and distance within 0.5 μm
B: A condition not met, with the angle being within ±10° and distance within 20 μm
C: B condition not met
Bubble/Black spot resistance
A: Outstandingly excellent,
B: Excellent,
C: Fair,
D: Marginally inferior,
E: Problematic
Fishscale resistance
A: Outstandingly excellent,
B: Excellent,
C: Marginally excellent,
D: Fair.
E: Problematic
*Inferior productivity owing to poor threading performance in annealing

INDUSTRIAL APPLICABILITY

The enameling steel sheet of the present invention is a non-aging enameling steel sheet having excellent fishscale resistance characteristics that is suitable for one-coat enameling. The enameling steel sheet of the present invention is a steel sheet increased in hydrogen trapping capability by controlling variation of composite oxide composition so as to improve void formation performance in the steel sheet. The invention steel sheet has outstandingly good fishscale resistance not only in direct one-coat enameling but also in two-coat enameling. Moreover, the invention enameling steel sheet is not susceptible to the occurrence of bubbles and/or black spot defects and is excellent in enamel adhesion. Compatibility with glazing methods includes trouble-free utilization not only with wet glazing but also with enameling using a dry powder. The invention enameling steel sheet is not subject to any limitation regarding application and exhibits its characteristic features when applied to bathtubs, tableware, kitchen utensils, building materials, household electrical appliance panels, and other products falling in the technical category of enameled steel sheet.

EXPLANATION OF SYMBOLS

1 Coarse complex oxides
2 Hot rolling
3 Elongation
4 Cold rolling
5 Fracture voids (Hydrogen trap)
6 Coarse oxides
7 Fine complex voids
8 Voids (Hydrogen trap)
9 Difference concentration oxides
10 Large voids space
11 Same concentration oxides
12 Small voids space
13 No elongation

The invention claimed is:

1. An enameling steel sheet excellent in fishscale resistance comprising a chemical composition consisting of, in mass %, C: 0.0003% to 0.010%,
Si: 0.001% to 0.100%,
Mn: 0.03% to 1.30%,
Al: 0.0002% to 0.010%,
N: 0.0055% or less,
P: 0.035% or less,
S: 0.08% or less,
O: 0.005% to 0.085%,
Nb: 0.113% to 0.250%,
optionally B: 0.0003 to 0.0030%,
optionally V: 0.003 to 0.15%,
optionally Ti: 0.0001 to 0.05%,
optionally Cr: 0.0001 to 0.05%,
optionally one or more of Ta, W, La, Ce, Ca or Mg in a total of 1.0% or less,
optionally one or more of As, Se, Sn or Sb in a total of 1.0% or less, and
a balance of Fe and unavoidable impurities, wherein
the enameling steel sheet further comprises:
a first Fe—Nb—Mn system composite oxide, selected from the enameling steel sheet at random, the first Fe—Nb—Mn system composite oxide having internal variation of Nb mass % concentrations, wherein the Nb mass % concentration of a high-concentration region, Nb max %, of the first Fe—Nb—Mn system composite oxide is higher than the Nb mass % concentration of a low-concentration region, Nb min %, of the first Fe—Nb—Mn system composite oxide, and a ratio of Nb max %/Nb min %≥1.2.

2. The enameling steel sheet excellent in fishscale resistance as set forth in claim 1, further comprising, in mass %, at least one of B: 0.0003 to 0.0030%,
V: 0.003 to 0.15%,
Ti: 0.0001 to 0.05%,
Cr: 0.0001 to 0.05%,
one or more of Ta, W, La, Ce, Ca or Mg in a total of 1.0% or less, or
one or more of As, Se, Sn or Sb in a total of 1.0% or less.

3. The enameling steel sheet excellent in fishscale resistance as set forth in claim 2, further comprising a second Fe—Nb—Mn system composite oxide, said second Fe—Nb—Mn system composite oxide having an Nb mass % concentration of not less than 1.2 times the Nb mass % concentration of said first composite oxide, wherein a straight line distance between the centers of the first and second composite oxides is not less than 0.10 μm and no more than 20 μm, and a straight line connecting the centers of the first and second composite oxides is at an angle within ±10° of a rolling direction of the steel sheet.

4. The enameling steel sheet excellent in fishscale resistance as set forth in claim 2, further comprising a second Fe—Nb—Mn system composite oxide in the steel sheet having internal variation in the Mn mass % concentration such that the Mn mass % concentration of a high-concentration region (Mn max %) and the Mn mass % concentration of a low-concentration region (Mn min %) are present in a ratio of Mn max %/Mn min %≥1.2.

5. The enameling steel sheet excellent in fishscale resistance as set forth in claim 2, further comprising a second Fe—Nb—Mn system composite oxide, said second Fe—Nb—Mn system composite oxide having an Mn mass % concentration of not less than 1.2 times the Mn mass % concentration of said first composite oxide, and a straight line distance between the centers of the first and second composite oxides is not less than 0.10 μm and no more than 20 μm, and a straight line connecting the centers of the first and second composite oxides is at an angle within ±10° of a rolling direction of the steel sheet.

6. The enameling steel sheet according to claim 2, wherein the first Fe—Nb—Mn system composite oxide is elongated and fractured, forming fracture voids in the steel sheet.

7. A method of producing a continuously cast enameling steel sheet excellent in fishscale resistance, comprising, following the making and continuously casting of a steel of the composition set forth in claim 1, hot-rolling a continuously cast steel slab of a thickness of at least 50 mm at a temperature of at least 600° C., wherein the hot-rolling is first conducted at a temperature of at least 1000° C. and a strain rate of at least 1/sec to a total true strain of at least 0.4, and hot-rolling is then conducted at a temperature no more than of 1000° C. and a strain rate of at least 10/sec to a total true strain of at least 0.7.

8. The enameling steel sheet according to claim 1, wherein the first Fe—Nb—Mn system composite oxide is elongated and fractured, forming fracture voids in the steel sheet.

9. A method of producing a continuously cast enameling steel slab excellent in fishscale resistance in a process of making and continuously casting a steel of the composition set forth in claim 1, comprising adding Mn and Nb to molten steel during steelmaking by adding at least 80% of the total amount of Mn added to the molten steel, allowing 1 minute or more to pass, adding at least 80% of the total amount of Nb to be added to the molten steel, and conducting continuous casting within a period of 60 minutes.

10. The method of producing a continuously cast enameling steel slab excellent in fishscale resistance as set forth in claim 9, wherein, in the continuous casting, the cooling rate during solidification at a slab-thickness direction layer measuring ¼ the thickness of the original slab is not greater than 10° C./sec.

11. The method of producing a continuously cast enameling steel slab excellent in fishscale resistance as set forth in claim 7, further comprising forming an Fe—Nb—Mn system composite oxide in the continuously cast steel slab, the Fe—Nb—Mn system composite oxide having an average diameter of at least 1.0 μm, and a distribution of Nb mass % concentrations, wherein the Nb mass % concentration of a high concentration portion (Nb max %) of the Fe—Nb—Mn system composite oxide is higher than the Nb mass % concentration of a low concentration portion (Nb min %) of the Fe—Nb—Mn system composite oxide, and the high-concentration portion and the low-concentration portion are present in a ratio of Nb max %/Nb min %≥1.2.

12. The method of producing a continuously cast enameling steel slab excellent in fishscale resistance as set forth in claim 9, further comprising forming an Fe—Nb—Mn system composite oxide, having an average diameter of at least 1.0 μm in the continuously cast steel slab, and a variation of Mn mass % concentration, wherein the Mn mass % concentration of a high concentration portion (Mn max %) of the Fe—Nb—Mn system composite oxide and the Mn mass % concentration of a low concentration portion (Mn min %) of the Fe—Nb—Mn system composite oxide are present in a ratio of Mn max %/Mn min %≥1.2.

13. The method of producing a continuously cast enameling steel slab excellent in fishscale resistance as set forth in claim 9, wherein, following the continuous casting process, hot-rolling a continuously cast steel slab having a thickness of at least 50 mm at a temperature of at least 600° C., wherein the hot-rolling is first conducted at a temperature of at least 1000° C. and a strain rate of at least 1/sec to a total true strain of at least 0.4, and the hot-rolling is then conducted at a temperature of no more than 1000° C. and a strain rate of at least 10/sec to a total true strain of at least 0.7.

14. An enameling steel sheet excellent in fishscale resistance, comprising a chemical composition consisting of, in mass %:

C: 0.0003% to 0.010%,
Si: 0.001% to 0.100%,
Mn: 0.03% to 1.30%,
Al: 0.0002% to 0.010%,
N: 0.0055% or less,
P: 0.035% or less,
S: 0.08% or less,
O: 0.005% to 0.085%,
Nb: 0.113% to 0.250%,
optionally B: 0.0003 to 0.0030%,
optionally V: 0.003 to 0.15%,
optionally Ti: 0.0001 to 0.05%,
optionally Cr: 0.0001 to 0.05%,
optionally one or more of Ta, W, La, Ce, Ca or Mg in a total of 1.0% or less,
optionally one or more of As, Se, Sn or Sb in a total of 1.0% or less, and
a balance of Fe and unavoidable impurities, wherein
the enameling steel sheet further comprises:
a first and a second Fe—Nb—Mn system composite oxides, selected from the enameling steel sheet at random, said first composite oxide having an Nb mass % concentration of not less than 1.2 times the Nb mass % concentration of said second composite oxide, wherein a straight line distance between the centers of the first and second composite oxides is not less than 0.10 μm and no more than 20 μm, and a straight line connecting the centers of the first and second composite oxides is at an angle within ±10° of a rolling direction of the steel sheet.

15. The enameling steel sheet excellent in fishscale resistance as set forth in claim 14, comprising an Fe—Nb—Mn system composite oxide in the steel sheet having internal variation in the Nb mass % concentration such that the Nb mass % concentration of a high-concentration region (Nb max %) and the Nb mass % concentration of a low-concentration region (Nb min %) are present in a ratio of Nb max %/Nb min %≥1.2.

16. The enameling steel sheet excellent in fishscale resistance as set forth in claim 14, further comprising, in mass %, at least one of B: 0.0003 to 0.0030%,
V: 0.003 to 0.15%,
Ti: 0.0001 to 0.05%,
Cr: 0.0001 to 0.05%,
one or more of Ta, W, La, Ce, Ca or Mg in a total of 1.0% or less, or
one or more of As, Se, Sn or Sb in a total of 1.0% or less.

17. An enameling steel sheet excellent in fishscale resistance comprising a chemical composition consisting of, in mass %, C: 0.0003% to 0.010%,
Si: 0.001% to 0.100%,
Mn: 0.03% to 1.30%,
Al: 0.0002% to 0.010%,
N: 0.0055% or less,
P: 0.035% or less,
S: 0.08% or less,
O: 0.005% to 0.085%,
Nb: 0.113% to 0.250%,
optionally B: 0.0003 to 0.0030%,
optionally V: 0.003 to 0.15%,
optionally Ti: 0.0001 to 0.05%,
optionally Cr: 0.0001 to 0.05%,
optionally one or more of Ta, W, La, Ce, Ca or Mg in a total of 1.0% or less,
optionally one or more of As, Se, Sn or Sb in a total of 1.0% or less, and
a balance of Fe and unavoidable impurities,
the enameling steel sheet further comprising:
a first Fe—Nb—Mn system composite oxide, selected from the enameling steel sheet at random, wherein the first Fe—Nb—Mn system composite oxide in the steel sheet has internal variation in the Mn mass % concentration, such that the Mn mass % concentration of a high-concentration region (Mn max %) and the Mn mass % concentration of a low-concentration region (Mn min %) are present in a ratio of Mn max %/Mn min %≥1.2.

18. The enameling steel sheet excellent in fishscale resistance as set forth in claim 17, comprising an Fe—Nb—Mn system composite oxide in the steel sheet having internal variation in the Nb mass % concentration such that the Nb mass % concentration of a high-concentration region (Nb max %) and the Nb mass % concentration of a low-concentration region (Nb min %) are present in a ratio of Nb max %/Nb min %≥1.2.

19. The enameling steel sheet excellent in fishscale resistance as set forth in claim 17, further comprising, in mass %, at least one of B: 0.0003 to 0.0030%,
V: 0.003 to 0.15%,
Ti: 0.0001 to 0.05%,
Cr: 0.0001 to 0.05%,
one or more of Ta, W, La, Ce, Ca or Mg in a total of 1.0% or less, or
one or more of As, Se, Sn or Sb in a total of 1.0% or less.

20. An enameling steel sheet excellent in fishscale resistance, comprising a chemical composition consisting of, in mass %,
C: 0.0003% to 0.010%,
Si: 0.001% to 0.100%,
Mn: 0.03% to 1.30%,
Al: 0.0002% to 0.010%,
N: 0.0055% or less,
P: 0.035% or less,
S: 0.08% or less,
O: 0.005% to 0.085%,
Nb: 0.113% to 0.250%, and
optionally B: 0.0003 to 0.0030%,
optionally V: 0.003 to 0.15%,
optionally Ti: 0.0001 to 0.05%,
optionally Cr: 0.0001 to 0.05%,
optionally one or more of Ta, W, La, Ce, Ca or Mg in a total of 1.0% or less,
optionally one or more of As, Se, Sn or Sb in a total of 1.0% or less, and
a balance of Fe and unavoidable impurities,
the enameling steel sheet further comprising:
a first and a second Fe—Nb—Mn system composite oxides, selected from the enameling steel sheet at random, said first composite oxide having an Mn mass % concentration not less than 1.2 times the Mn mass % concentration of said second composite oxide, and a straight line distance between the centers of the first and second composite oxides is not less than 0.10 μm and no more than 20 μm, and a straight line connecting the centers of the first and second composite oxides is at an angle within ±10° of a rolling direction.

21. The enameling steel sheet excellent in fishscale resistance as set forth in claim 20, comprising an Fe—Nb—Mn system composite oxide in the steel sheet having internal variation in the Nb mass % concentration such that the Nb mass % concentration of a high-concentration region (Nb max %) and the Nb mass % concentration of a low-concentration region (Nb min %) are present in a ratio of Nb max %/Nb min %≥1.2.

22. The enameling steel sheet excellent in fishscale resistance as set forth in claim 20, further comprising, in mass %, at least one of
B: 0.0003 to 0.0030%,
V: 0.003 to 0.15%,
Ti: 0.0001 to 0.05%,
Cr: 0.0001 to 0.05%,
one or more of Ta, W, La, Ce, Ca or Mg in a total of 1.0% or less, or
one or more of As, Se, Sn or Sb in a total of 1.0% or less.

* * * * *